US007552984B2

(12) United States Patent
Hayashi et al.

(10) Patent No.: US 7,552,984 B2
(45) Date of Patent: Jun. 30, 2009

(54) INKJET RECORDING APPARATUS AND INKJET RECORDING METHOD

(75) Inventors: Masashi Hayashi, Sagamihara (JP); Norihiro Kawatoko, Yokohama (JP); Hidehiko Kanda, Yokohama (JP); Toshiyuki Chikuma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 11/749,011

(22) Filed: May 15, 2007

(65) Prior Publication Data

US 2007/0291059 A1 Dec. 20, 2007

(30) Foreign Application Priority Data

Jun. 20, 2006 (JP) ..... 2006-170250

(51) Int. Cl.
*B41J 29/38* (2006.01)

(52) U.S. Cl. ..... 347/14; 347/9; 347/12

(58) Field of Classification Search ..... 347/14, 347/19, 20, 43
See application file for complete search history.

(56) References Cited

U.S. PATENT DOCUMENTS 5,956,055 A 9/1999 Gibson et al.
6,527,359 B1 * 3/2003 Otsuki ..... 347/19

FOREIGN PATENT DOCUMENTS

| | | | |
|---|---|---|---|
| JP | 07-040551 | A | 2/1995 |
| JP | 07-309007 | A | 11/1995 |
| JP | 2004-009489 | A | 1/2004 |

* cited by examiner

*Primary Examiner*—Thinh H Nguyen
(74) *Attorney, Agent, or Firm*—Canon U.S.A., Inc., IP Division

(57) ABSTRACT

An inkjet recording apparatus includes a recording head having a nozzle array of plural nozzles capable of discharging ink. The inkjet recording apparatus performs a scanning/recording operation for forming an image on a recording medium by shifting the recording head in a main scanning direction. The inkjet recording apparatus repeatedly perform the scanning/recording operation and a recording medium conveying operation. The inkjet recording apparatus sets a recording position correction amount for each section of the nozzle array based on information relating to the inclination, so that a recording position correction amount in a forward scanning operation is different from a recording position correction amount in a backward scanning operation.

19 Claims, 31 Drawing Sheets

COMMON IN FORWARD
AND BACKWARD DIRECTIONS

INKJET RECORDING APPARATUS AND INKJET RECORDING METHOD

BACKGROUND OF THE INVENTION

1. Field of the Invention

The present invention relates to an inkjet recording apparatus that includes a recording head capable of discharging ink on a recording medium.

2. Description of the Related Art

A recording apparatus includes a recording head shifting in a direction perpendicular to a conveying direction of a recording medium (e.g., a paper). The recording head for a recording apparatus is a wire-dot type, a thermal type, a heat transfer type, or an inkjet type.

An inkjet recording head does not cause frictions with a recording medium due to its non-contact nature and is capable of realizing high-speed printing. An ink droplet, discharged from a recording head, impacts on a recording medium spaced from the recording head. The inkjet recording head has low noise in a recording operation and can effectively output color inks at a low running cost.

However, depending on a positional relationship between a recording head and a carriage, or due to a tolerance in a process of forming ink discharge ports on a recording head, an array of ink discharge ports may incline relative to a line feed (LF) direction (i.e., a recording medium conveying direction). If a recording head having an inclined ink discharge port array is used to record a vertical rule, a recorded rule inclines relative to an ideal line.

An image recording apparatus including a plurality of discharge ports disposed in parallel can discharge different color inks from respective discharge port arrays. An image recording apparatus performing color printing may generate image deterioration, such as granular quality deterioration, due to tiny deviation in impact position of discharged ink dots. In particular, output image quality tends to greatly deteriorate in a multi-pass printing operation performing forward/backward printing operations.

A conventional correction method applicable to a recording apparatus includes obtaining the inclination of a discharge port (nozzle) array and shifting the ink discharging timing so as to adjust a dot impact position to an ideal state in a main scanning direction.

A conventional inclination correcting method discussed in U.S. Pat. No. 5,956,055 is applicable to a recording apparatus that performs a first scanning operation using a lower nozzle section for dot recording, a recording paper feeding operation, and a second scanning operation using an upper nozzle section for dot recording. The correction method discussed in this prior art includes obtaining a deviation amount (i.e., head inclination) of the dot position (impact position) in the main scanning direction based on the recorded dots, determining an offset amount of the recording position, and shifting at least part of the nozzles by a distance dependent on the determined offset amount.

Hereinafter, the inclination correcting method discussed in the U.S. Pat. No. 5,956,055 will be described in detail with reference to FIGS. 31 and 32. FIG. 31 illustartes a printing result of a vertical rule formed by a nozzle array inclined by a deviation amount equal to 2 dots/1200 dpi at front/rear edges of the nozzle array relative to the main scanning direction.

FIG. 32 illustartes a printing result of a vertical rule which is subjected to the conventional inclination correction discussed in U.S. Pat. No. 5,956,055. The correction according to this prior art includes shifting a nozzle division 3202 in the main scanning direction by an amount equal to 1 dot/1200 dpi without shifting a nozzle division 3201 positioned at an upper portion of an inclined nozzle array. More specifically, the drive timing for the nozzle division 3202 is changed by an amount equal to 1 dot/1200 dpi while the drive timing for the nozzle division 3201 is unchanged.

As apparent from the comparison between FIGS. 31 and 32, a width 3200 representing an impact deviation amount of a corrected vertical rule in the main scanning direction is shorter than a width 3100 representing an impact deviation amount of a non-corrected vertical rule (i.e., width 3200<width 3100). Thus, it is understood that the inclination correction can obtain a corrected vertical rule resembling an ideal output state.

As discussed in Japanese Patent Application Laid-Open No. 07-309007, a conventional inkjet printing system includes an error correcting circuit capable of visually reducing a rotational error of a recording head with an offset added to a nozzle for correcting a recorded image.

As discussed in Japanese Patent Application Laid-Open No. 07-40551, a conventional inkjet recording apparatus changes the order of driven blocks and also changes the interval of the blocks according to the inclination. Furthermore, as discussed in Japanese Patent Application Laid-Open No. 2004-9489, a conventional inkjet recording apparatus includes a unit capable of changing data allocated to a nozzle based on the inclination of a head.

The above-described conventional inclination correcting methods have the following problems.

First problem: Band unevenness generated by bidirectional misregistration

The above-described conventional inclination correcting methods can improve the printing quality by reducing an impact position deviation width of a vertical rule in the main scanning direction if a recording head is inclined.

However, according to the above-described conventional inclination correcting methods, no special consideration is made for a printed result of multi-pass printing. The multi-pass printing is characterized in that a recording head performs plural scanning operations in a same region before a final image is formed.

The multi-pass printing can bring optimized effects when a dot impact position in a forward printing operation completely overlaps with a dot impact position in a backward printing operation (the registration is matching in forward/backward directions).

However, in a multi-pass printing performing forward/backward printing operations for realizing a high-speed image output, no consideration is given to a method for correcting band unevenness generated due to slight deviation in the dot impact position between the forward printing operation and the backward printing operation (i.e., misregistration in forward/backward directions).

In general, the misregistration in forward/backward directions tends to be easily generated if the setting by a user or a sensor is performed. Furthermore, users are sensitive to any deterioration on an image and therefore an image, if it deteriorates due to band unevenness, maybe recognized as having an extremely lower quality level. Accordingly, a printing control method capable of suppressing band unevenness generation is required.

Second problem: Costs for realizing higher correction resolution

According to an inclination correcting method depending on correction data, a recording apparatus processes a great amount of data to improve data resolution. For the correction capable of visually eliminating any deviation in the recording position, a recording apparatus processes a great amount of image data and cannot perform a recording operation at a higher speed. The cost for a recording apparatus increases.

Furthermore, according to an inclination correcting method depending on a head driving control, a recording apparatus generates and selects a plurality of drive signals to improve correction resolution. This method also complicates a recording apparatus and increases the cost for the recording apparatus.

SUMMARY OF THE INVENTION

Exemplary embodiments of the present invention are directed to a technique capable of suppressing deterioration in granular quality and minimizing image quality deterioration if band unevenness is generated on an output image.

According to an aspect of the present invention, when a printer has an inclined recording head, the printer differentiates a recording position correction amount (i.e., dot position shifting amount) in a forward scanning operation from a recording position correction amount in a backward scanning operation.

According to an aspect of the present invention, the above-described image output can be realized even when the dot position shifting amount is rough compared to a deviation amount of a leading edge of an inclined head in the main scanning direction.

According to an aspect of the present invention, an inkjet recording apparatus includes a recording head having a nozzle array of plural nozzles capable of discharging ink. The inkjet recording apparatus shifts the recording head in forward and backward directions along a main scanning direction to perform scanning and recording operations for discharging the ink from the nozzles onto a recording medium to form an image. The inkjet recording apparatus conveys the recording medium by a predetermined amount in a sub scanning direction intersectional to the main scanning direction. The inkjet recording apparatus includes: an acquiring unit configured to obtain information relating to an inclination of the nozzle array of the recording head relative to the sub scanning direction; a dividing unit configured to divide the nozzle array into a plurality of sections; and a recording position correction unit configured to correct, in the main scanning direction, the position of dots recorded by a nozzle group of each section. The recording position correction unit sets a recording position correction amount for each section based on the information relating to the inclination, so that a recording position correction amount in a forward scanning operation is different from a recording position correction amount in a backward scanning operation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Figure 1:
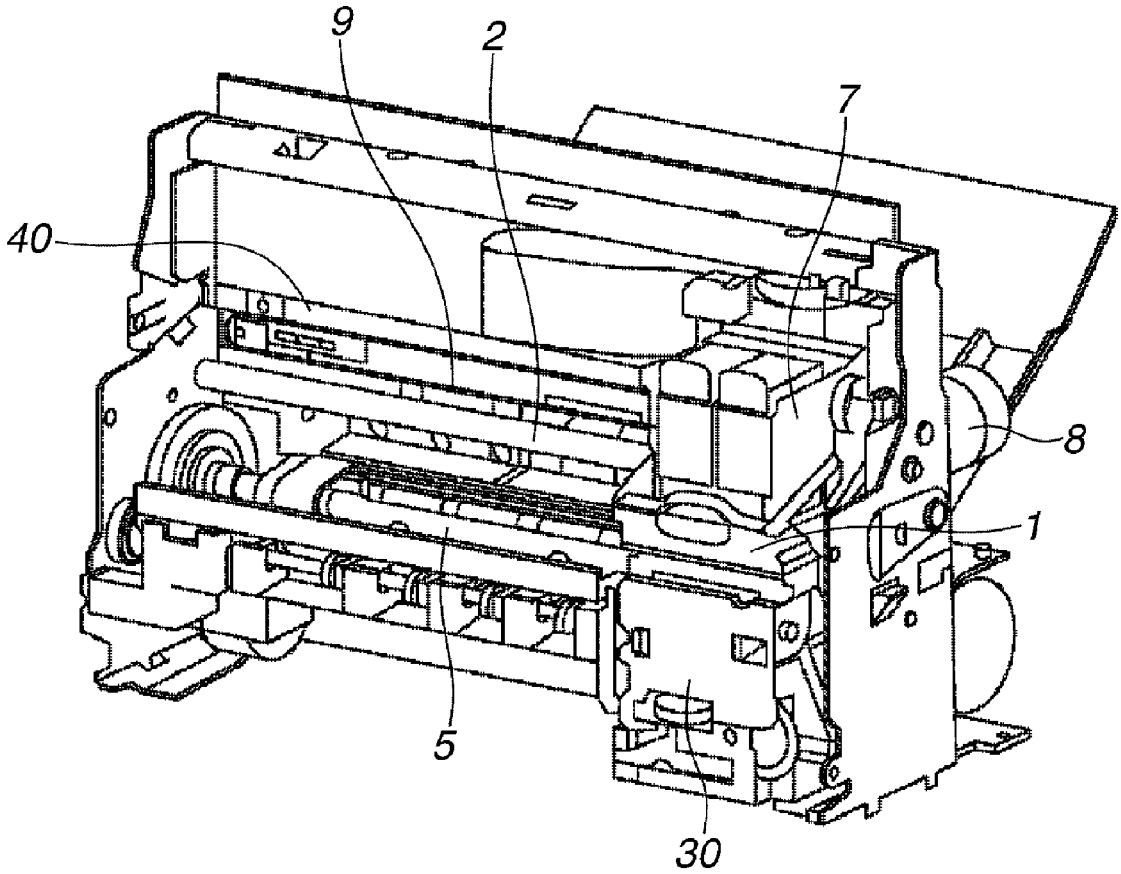
FIG. 1 is a perspective view illustrating an appearance of a printer according to an exemplary embodiment of the present invention.

The following description of exemplary embodiments is merely illustrative in nature and is in no way intended to limit the invention, its application, or uses.

Processes, techniques, apparatus, and systems as known by one of ordinary skill in the art may not be discussed in detail but are intended to be part of the enabling description where appropriate.

For example, certain circuitry for image processing, data processing, and other uses may not be discussed in detail. However these systems and the methods to fabricate these system as known by one of ordinary skill in the relevant art is intended to be part of the enabling disclosure herein where appropriate.

It is noted that throughout the specification, similar reference numerals and letters refer to similar items in the following figures, and thus once an item is described in one figure, it may not be discussed for following figures.

Exemplary embodiments will be described in detail below with reference to the drawings.

FIG. 1 is a perspective view illustrating an appearance of an inkjet serial printer according to an exemplary embodiment of the present invention, with a cover removed from a printer body.

A carrier 1, supported by a guide shaft 2 and guide rails (not illustrated), can shift relative to an line feed (LF) roller 5 and a platen (not illustrated) so as to move in forward and backward directions. A recording head 7 is mounted on the carrier 1. A belt 9 transmits a driving force of a carrier motor 8 to the carrier 1 so that the carrier 1 can shift in both forward and backward directions along the guide shaft 2.

In a recording operation, the carrier 1 accelerates until it reaches a predetermined speed and then shifts at a constant speed. In this condition, the printer drives the recording head 7 based on recording data received from an associated image processing device (e.g., a personal computer). The recording head 7 discharges ink on a recording medium conveyed by the LF roller 5.

When a first scanning operation of the recording head 7 is completed, the carrier 1 decelerates and stops. The LF roller 5 conveys the recording medium in a predetermined conveyance direction perpendicular to the guide shaft 2 by an amount equivalent to a recording width in the first scanning operation. The printer alternately repeats the scanning by the recording head 7 and the conveyance of the recording medium by the LF roller 5 until a recording on the recording medium is completed.

A pump base 30, provided at a home position of the carrier 1, is a maintenance device for the recording head 7. The carrier 1 returns the home position in a power-off state of the printer. The pump base 30 covers a discharge surface of the recording head 7 with a cap so as to prevent evaporation of ink components when recording is not performed for a long time. Furthermore, the pump base 30 is capable of cleaning the discharge surface and absorbing wastes on the surface to maintain discharge performance of the recording head 7.

Figure 2:
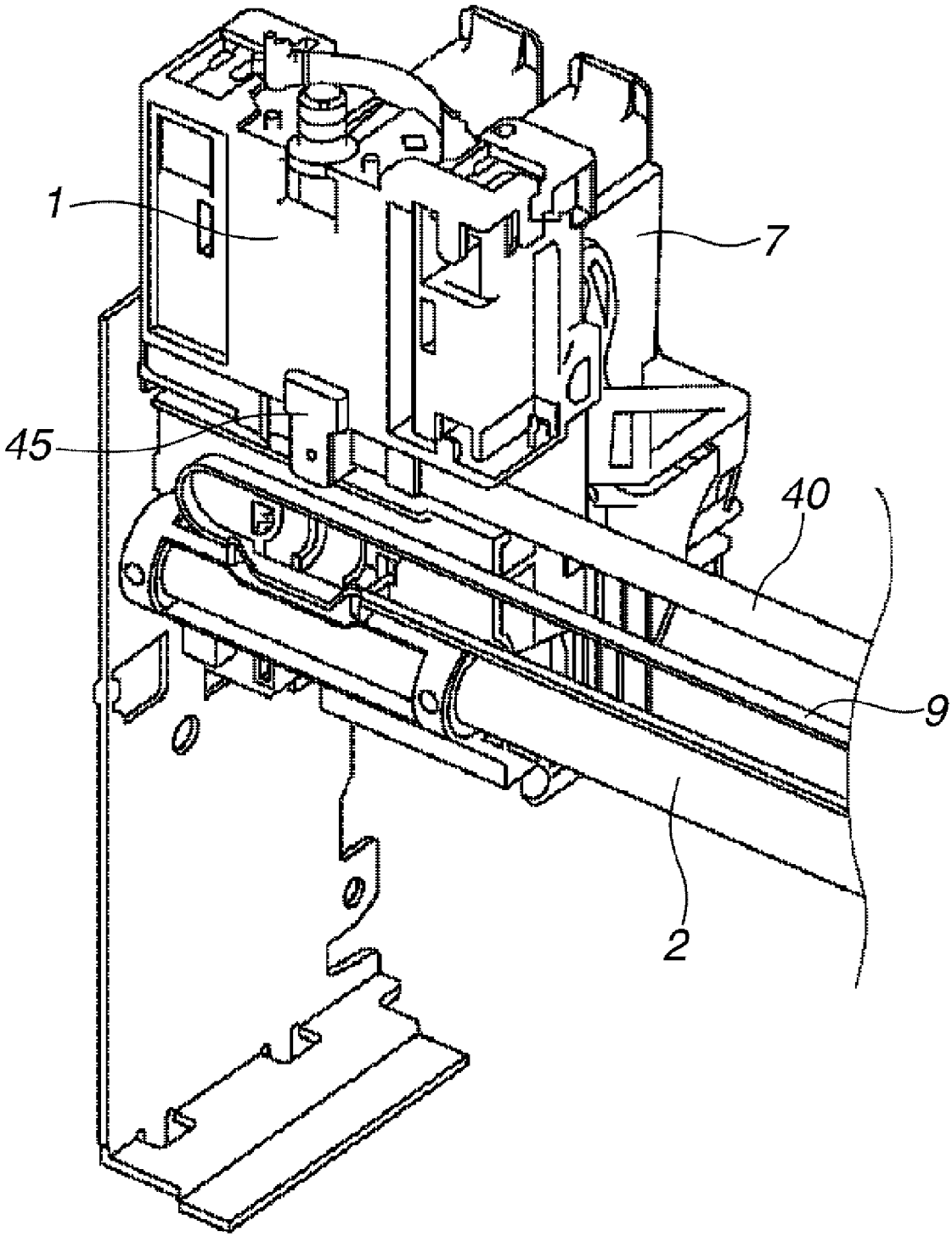
FIG. 2 is a perspective view illustrating a driving mechanism for a carrier.

FIG. 2 is a perspective view illustrating an exemplary driving mechanism for the carrier 1. The guide shaft 2, fixed to a chassis of the printer, can guide the reciprocating (forward and backward) motion of the carrier 1.

The belt 9, entrained between a pair of rollers at right and left edges of the printer, is linked to the carrier motor 8 fixed on the chassis. The belt 9 is fixed to the carrier 1. The belt 9 converts a rotational motion of the carrier motor 8 into a reciprocating (to-and-fro) motion. The belt 9 shifts the carrier 1. An encoder scale 40 includes plural marks disposed at constant pitches. The encoder scale 40 is supported by the chassis with a predetermined tension.

For example, the marks on the encoder scale 40 are disposed at the intervals of 300 LPI (lines per inch), i.e., 25.4 mm/300=84.6 μm. An encoder sensor 45 fixed to the carrier 1 can detect the marks and accurately obtain a momentary position of the carrier 1. The encoder sensor 45 can be an optical type or a magnetic type.

The printer compares the positional information obtained by the encoder sensor 45 with setting (start and end) values of a window that defines a recording region for a discharge port array (nozzle array) of the recording head 7. More specifically, the printing operation of the recording head 7 is restricted by the window that defines start and positions of a printable region in a main scanning direction. In this respect, the window represents a region corresponding to an enable signal.

The recording head 7 starts discharging ink from its discharge ports when the positional information obtained by the encoder sensor 45 agrees with the start position of the window. The recording head 7 terminates discharging the ink when the positional information agrees with the end position of the window.

Furthermore, during a scanning operation of the carrier 1, the printer can calculate a shift speed of the carrier 1 based on a time interval between continuous detections of the marks on the linear encoder scale 40.

Figure 3:
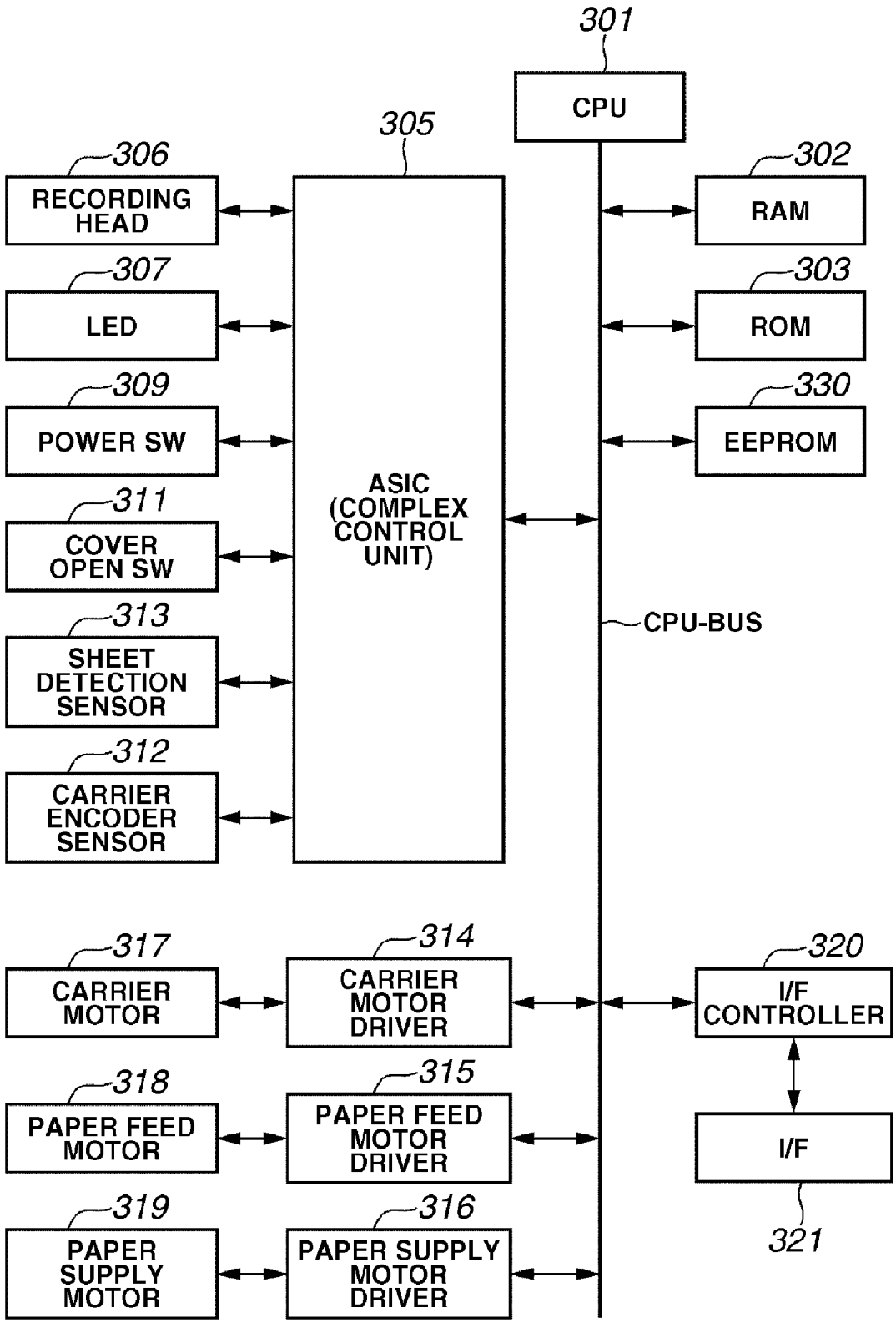
FIG. 3 is a block diagram illustrating an exemplary control system for an inkjet serial printer.

FIG. 3 is a block diagram illustrating an exemplary control system for an inkjet serial printer.

The control system illustrated in FIG. 3 includes a central processing unit (CPU) 301 that performs an overall control for the printer. The CPU 301 reads a control program from a read-only memory (ROM) 303 and executes the program based on various command signals which may be input, via a complex control unit (ASIC) 305, from various sensors (e.g., a carrier encoder sensor 312 and a sheet detection sensor 313) and various switches (e.g., a power switch 309 and a cover open SW 311) provided on an operation panel.

Furthermore, the control system illustrated in FIG. 3 includes an interface (I/F) controller 320 that reads a recording command transmitted from a host apparatus via an interface 321. The CPU 301 controls three motors (i.e., a carrier motor 317, a paper feed motor 318, and a paper supply motor 319) via motor drivers 314 through 316 based on a recording command. The CPU 301 transfers recording data, via the complex control unit 305, to a recording head (inkjet head) 306. The recording head 306 performs a recording control based on the received command.

The control system illustrated in FIG. 3 includes a random access memory (RAM) 302 that functions as a printer RAM capable of temporarily storing data and information. The RAM 302 can function as a reception buffer that temporarily stores rasterized recording data and various data (e.g., recording commands and recording data) received from the host apparatus. Furthermore, the RAM 302 can function as a work memory storing a recording speed or other information, and can function as a work area of the CPU 301.

The control system illustrated in FIG. 3 includes the ROM 303 that functions as a printer ROM capable of storing various programs and data. For example, the CPU 301 transfers the recording data to the recording head 306 based on a recording control program stored in the ROM 303. The recording head 306 performs a recording operation based on the recording data. The CPU 301 controls the motors 317 through 319 based on a motor control program stored in the ROM 303. Furthermore, the ROM 303 stores a printer emulation program and recording font data.

The complex control unit (ASIC) 305 detects an operation state of the recording head 306, a turned on/off state or a flickering state of a power LED 307, and inputs signals from the power SW 309, the cover open SW 311, and the sheet detection sensor 313.

The control system illustrated in FIG. 3 includes motor drivers 314 through 316 that can drive the control motors 317 through 319 based on commands supplied from the CPU 301.

For example, the carrier motor 317 is a DC servo motor capable of performing a later-described servo control. Each of the paper feed motor 318 and the paper supply motor 319 is a stepping motor that can be easily controlled by the CPU 301.

The I/F controller 320 is connected via the interface 321 to a computer or a host apparatus (not illustrated). The interface 321 is a bidirectional interface capable of receiving recording commands and recording data from the host apparatus and transmitting error information of the printer.

The interface 321 can be a centronics interface, a universal serial bus (USB) interface, or any other interface. In an embodiment, a user of a host apparatus can set a printing mode of an image recording apparatus. The host apparatus transmits the setting information together with recording data and commands to the image recording apparatus.

The control system illustrated in FIG. 3 includes a non-volatile electrically erasable programmable read-only memory (EEPROM) 330 that stores registration adjusting values, recording sheet number, recording discharging dot number, ink tank exchange frequency, recording head exchange frequency, and user commanded cleaning operation execution frequency. The EEPROM 330 can stably store the written contents even after the power source is turned off.

Comparable Embodiment

First, problems of a conventional system will be described with reference to the following examples 1 through 6. More specifically, a recording head being inclined possibly degrades granular quality on an output image and generates band unevenness.

Furthermore, problems caused when a conventional inclination correction is applied to a degraded image will be described with reference to the following examples 7 through 9. In this case, the conventional inclination correction cannot suppress generation of band unevenness if a recording head is inclined and misregistration is generated in forward/backward directions.

EXAMPLE 1

Inclination of nozzle array: not inclined

Misregistration in forward/backward directions: not generated granular quality is good and band unevenness is not generated More specifically, X deviation at nozzle front/rear edges in 2-pass printing: 0

Amount of forward/backward misregistration: 0

Figure 4:
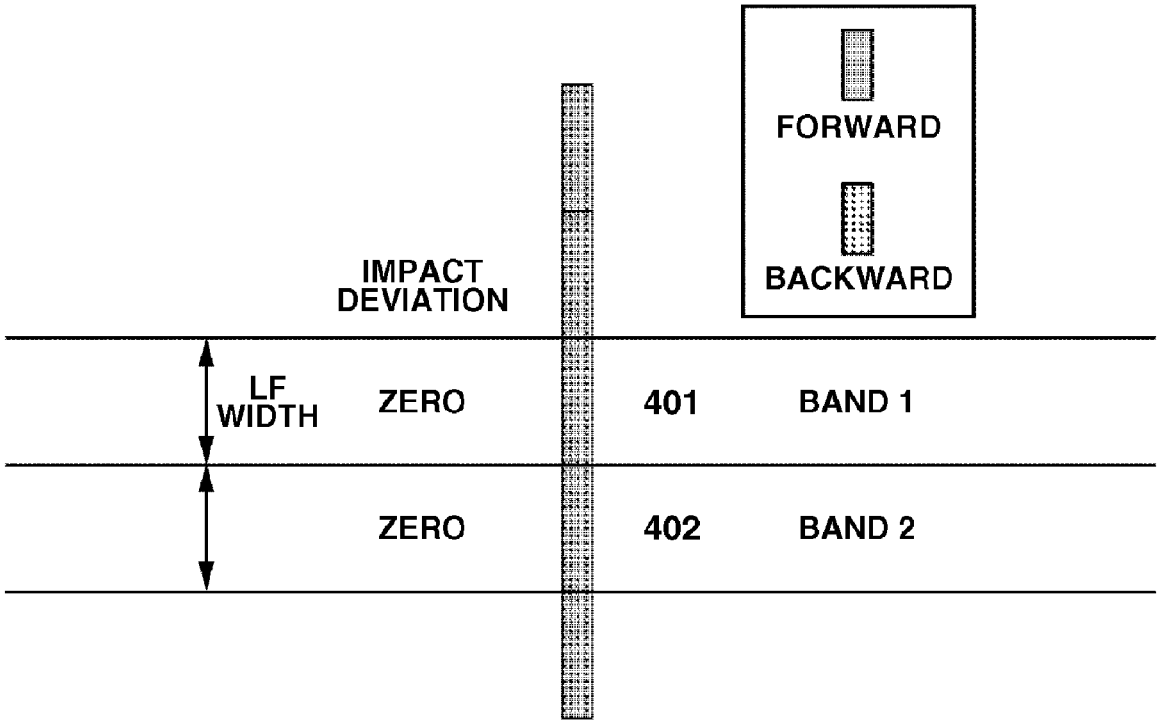
FIG. 4 illustrates an exemplary result of 2-pass printing performed by a recording head having a nozzle array that is not inclined relative to a line feed (LF) direction.

FIG. 4 illustrates an exemplary result (vertical rule) of 2-pass printing performed by a recording head that includes a nozzle array of 192 nozzles disposed in parallel with the LF direction (i.e. in an ideal condition). The 2-pass printing operation includes a forward scanning operation and a backward scanning operation. First, the recording head performs a forward scanning operation with lower 96 nozzles of the nozzle array that discharge ink to a band 1.

After completing the forward scanning operation, the printer performs a line feed (LF) operation to convey a recording medium by a predetermined LF width which corresponds to a printing width of the 96 nozzles.

Next, the recording head performs a backward scanning operation with upper 96 nozzles of the nozzle array that discharge ink to the band 1. After completing the backward scanning operation, the printer performs the LF operation to convey the recording medium by the LF width which corresponds to the printing width of the 96 nozzles.

Figure 5:
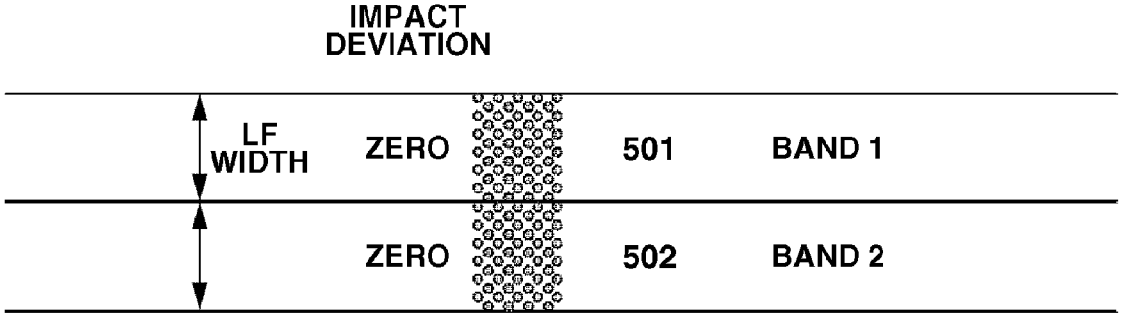
FIG. 5 illustrates exemplary dots overlapped in the 2-pass printing illustrated in FIG. 4.

Similarly, the recording head performs forward and backward scanning operations to form a printed image on a band 2. FIG. 5 illustrates exemplary dots overlapped in the 2-pass printing illustrated in FIG. 4.

According to the example 1, as understood from printed results 401 and 402 (i.e., printed results 501 and 502 illustrated in FIG. 5), the impact position of dots in the main scanning direction is completely identical in the forward and backward printing operations. In other words, the example 1 is an ideal print result of a rule whose dots are perfectly overlapped in the forward and backward printing operations.

EXAMPLE 2

Inclination of nozzle array: not inclined

Misregistration in forward/backward directions: generated granular quality is bad and band unevenness is not generated More specifically, X deviation at nozzle front/rear edges in 2-pass printing: 0

Amount of forward/backward misregistration: 1 dot/1200 dpi

Figure 6:
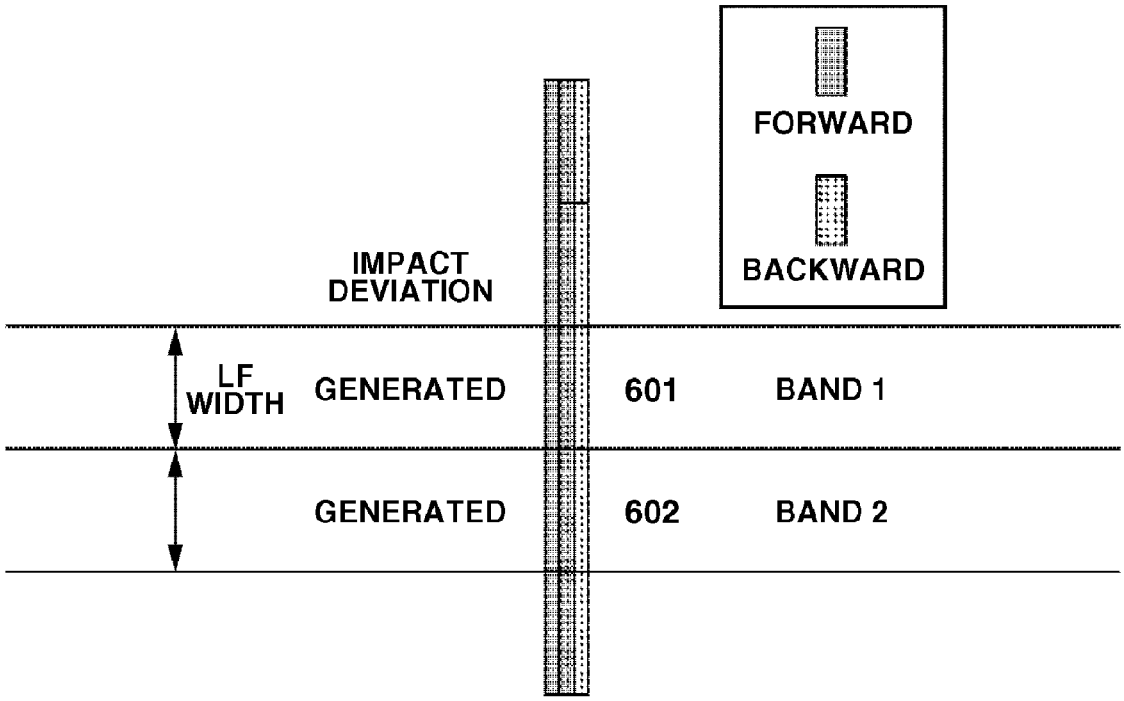
FIG. 6 illustrates an exemplary result of 2-pass printing performed by a recording head that has a nozzle array not inclined relative to the LF direction, which has generated misregistration in forward/backward directions.
Figure 7:
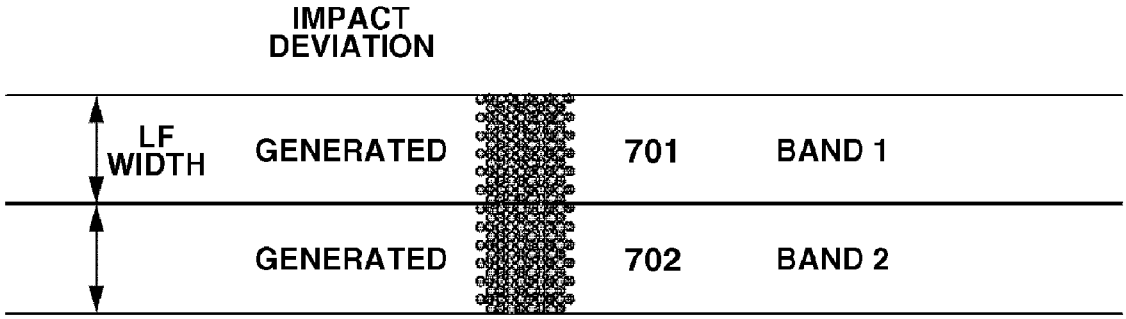
FIG. 7 illustrates exemplary dots overlapped in the 2-pass printing illustrated in FIG. 6.

FIG. 6 illustrates an exemplary result (vertical rule) of 2-pass printing performed by a recording head that has a nozzle array not inclined relative to the LF direction, which has generated misregistration in forward/backward directions. FIG. 7 illustrates exemplary dots overlapped in the 2-pass printing illustrated in FIG. 6.

According to the example 2, as understood from printed results 601 and 602 (i.e., printed results 701 and 702 illustrated in or FIG. 7), the impact position of dots in the main scanning direction uniformly deviates in the forward and backward printing operations. In other words, the 2-pass printing illustrated in FIGS. 6 and 7 has generated deterioration in granular quality due to deviation in the dot impact position. However, the example 2 has generated no band unevenness between bands 1 and 2.

EXAMPLE 3

Inclination of nozzle array: inclined
Misregistration in forward/backward directions: not generated
granular quality is bad and band unevenness is not generated More specifically,
X deviation at nozzle front/rear edges in 2-pass printing: 1 dot/600 dpi
Amount of forward/backward misregistration: 0

Figure 8:
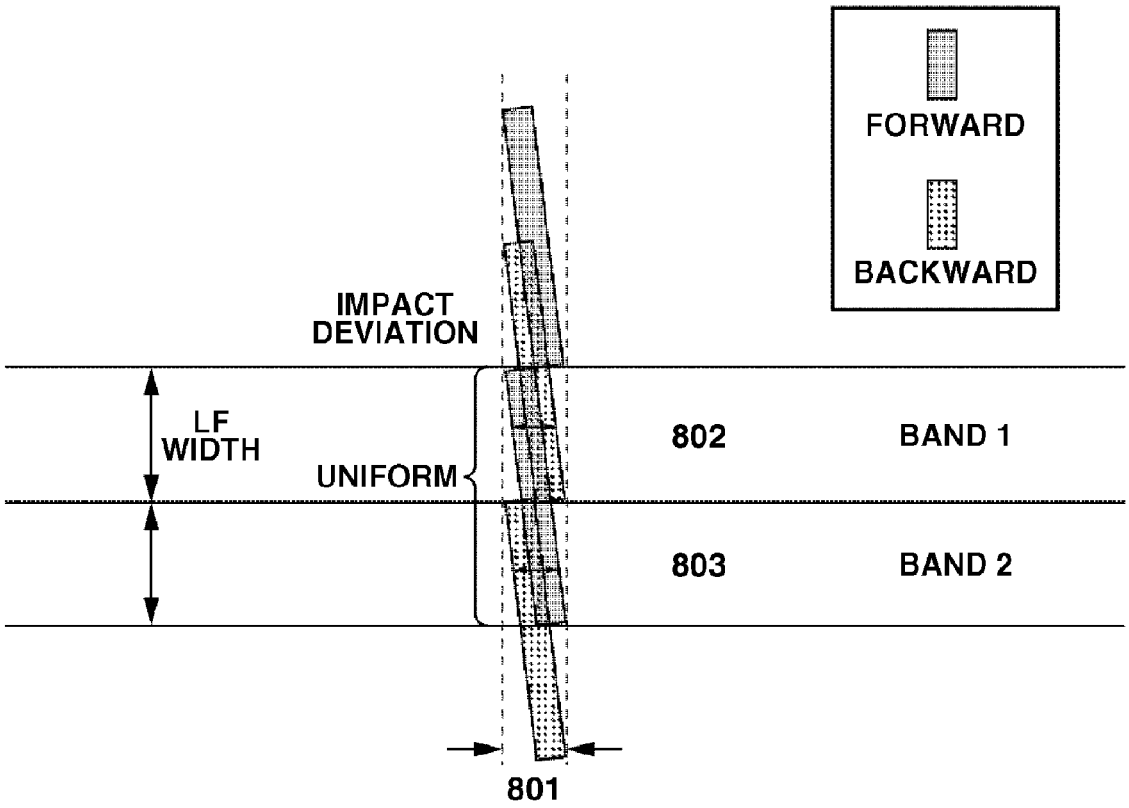
FIG. 8 illustrates an exemplary result of 2-pass printing performed by a recording head that has a nozzle array inclined relative to the LF direction.
Figure 9:
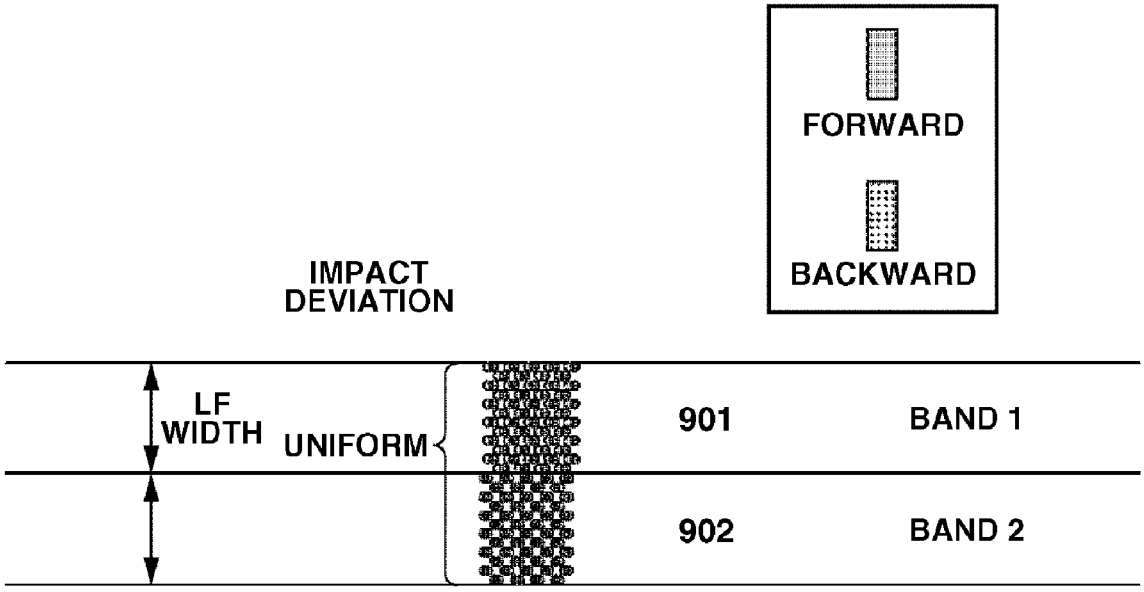
FIG. 9 illustrates exemplary dots overlapped in the 2-pass printing illustrated in FIG. 8.

FIG. 8 illustrates an exemplary result (vertical rule) of 2-pass printing performed by a recording head whose nozzle array is inclined relative to the LF direction. FIG. 9 illustrates exemplary dots overlapped in the 2-pass printing illustrated in FIG. 8. The example 3 has generated no misregistration in forward/backward directions.

First, to obtain a printed result 802, the recording head performs a backward scanning operation with a lower half of a nozzle array. Next, after the LF operation is completed, the recording head performs a forward scanning operation with an upper half of the nozzle array.

Due to inclination of the nozzle array, the recording results deviate from each other in the scanning direction even if the upper half and the lower half of the nozzle array perform recording at the same timing. Similarly, a printed result 803 can be obtained.

Namely, as understood from printed results 802 and 803 (i.e., printed results 901 and 902 illustrated in or FIG. 9), the impact position of dots in the main scanning direction deviates in the forward and backward printing operations. Thus, the example 3 is not an ideal print result of a rule because the dots are not perfectly overlapped in the forward and backward printing operations.

In other words, the 2-pass printing illustrated in FIGS. 8 and 9 has generated deterioration in granular quality due to deviation in the dot impact position. However, the example 3 has generated no band unevenness between bands 1 and 2.

EXAMPLE 4

Figure 10:
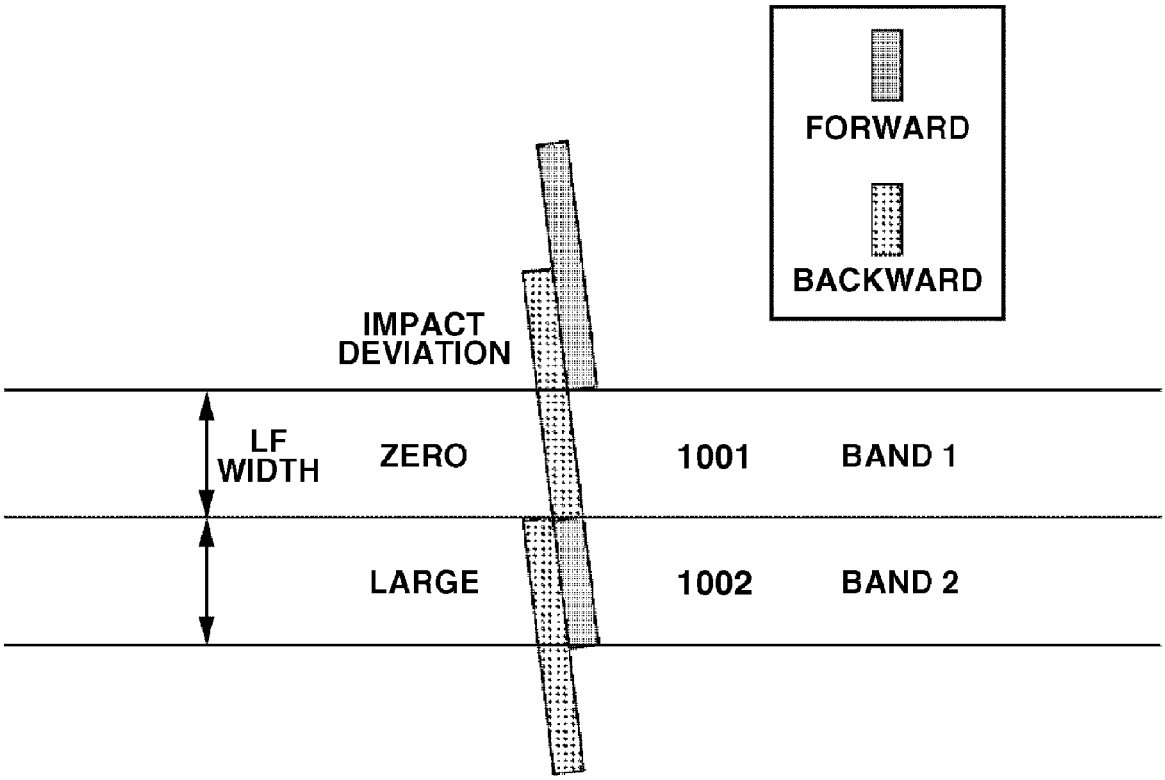
FIG. 10 illustrates an exemplary result of 2-pass printing performed by a recording head that has a nozzle array inclined relative to the LF direction, which has generated misregistration in forward/backward directions.
Figure 11:
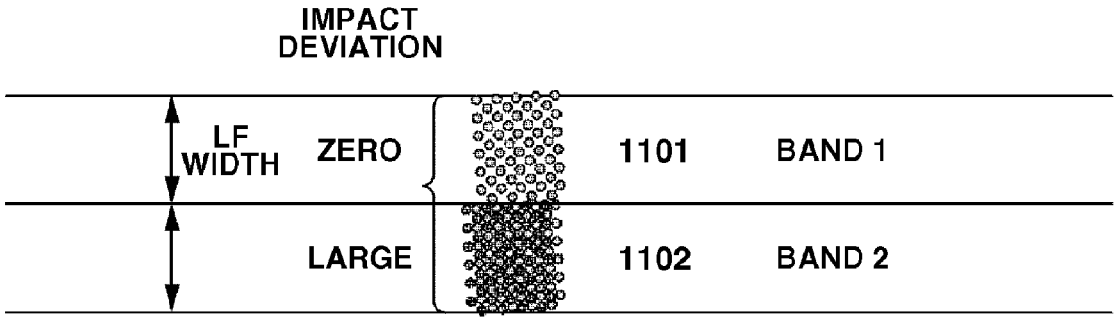
FIG. 11 illustrates exemplary dots overlapped in the 2-pass printing illustrated in FIG. 10.

Inclination of nozzle array: inclined
Misregistration in forward/backward directions: generated
granular quality is bad and band unevenness is generated More specifically,
X deviation at nozzle front/rear edges in 2-pass printing: 1 dot/600 dpi
Amount of forward/backward misregistration: 1 dot/1200 dpi FIG. 10 illustrates an exemplary result (vertical rule) of 2-pass printing performed by a recording head whose nozzle array is inclined relative to the LF direction, which has generated forward/backward misregistration. FIG. 11 illustrates exemplary dots overlapped in the 2-pass printing illustrated in FIG. 10.

According to the example illustrated in FIG. 10, the recording head performs a forward scanning operation with all nozzles to perform recording at a region above the band 1. After the LF operation is completed, the recording head performs a backward scanning operation with all nozzles to perform recording on the band 1 and the region above the band 1.

Furthermore, after the LF operation is executed, the recording head again performs the forward scanning operation with all nozzles to perform recording straddling the bands 1 and 2.

Finally, the recording head performs the backward scanning operation with all nozzles to perform recording on the band 2 and a region beneath the band 2.

According to the example illustrated in FIG. 10, the printed result 1001 has generated no deviation in the forward/backward registration. Thus, the dots perfectly overlap in the forward printing operation and the backward printing operation. On the other hand, the printed result 1002 has generated a deviation in recording position between the forward printing operation and the backward printing operation.

FIG. 11 illustrates a detailed state of dots overlapped in the printed results 1101 and 1102. Namely, the printed result 1101 includes dots perfectly overlapped in the forward and backward printing operations. On the other hand, the printed result 1102 includes dots deviated in the impact position. Accordingly, the example 4 using the recording head being inclined has generated misregistration in forward/backward directions.

According to the example 4, the image formed in each band having an LF width is differentiated in the state of dots overlapped (i.e., granularity). As a result, an output image of the example 4 has deteriorated in granular quality and generated band unevenness.

The band unevenness can be clearly recognized even when the amount of forward/backward misregistration is 1 dot/1200 dpi or less. In general, users are sensitive to any deterioration on an image and therefore a deteriorated image tends to be recognized as having an extremely lower quality level.

From the above-described examples 1 through 3, it is understood that the granular quality tends to deteriorate if misregistration in the forward/backward directions is generated even when the nozzle array is not inclined, or if the nozzle array is inclined even when misregistration in the forward/backward directions is not generated.

Furthermore, from the example 4, it is understood that band unevenness is generated if the nozzle array is inclined and misregistration in the forward/backward directions is generated.

As described below, the conventional inclination correction can obtain a corrected printed result resembling an ideal state even when the nozzle array is inclined.

EXAMPLE 5

Inclination of nozzle array: inclined
Misregistration in forward/backward directions: not generated
Inclination correction: conventional correction
granular quality is good and band unevenness is not generated More specifically,
X deviation at nozzle front/rear edges in 2-pass printing: 1 dot/600 dpi
Amount of forward/backward misregistration: 0

Figure 12:
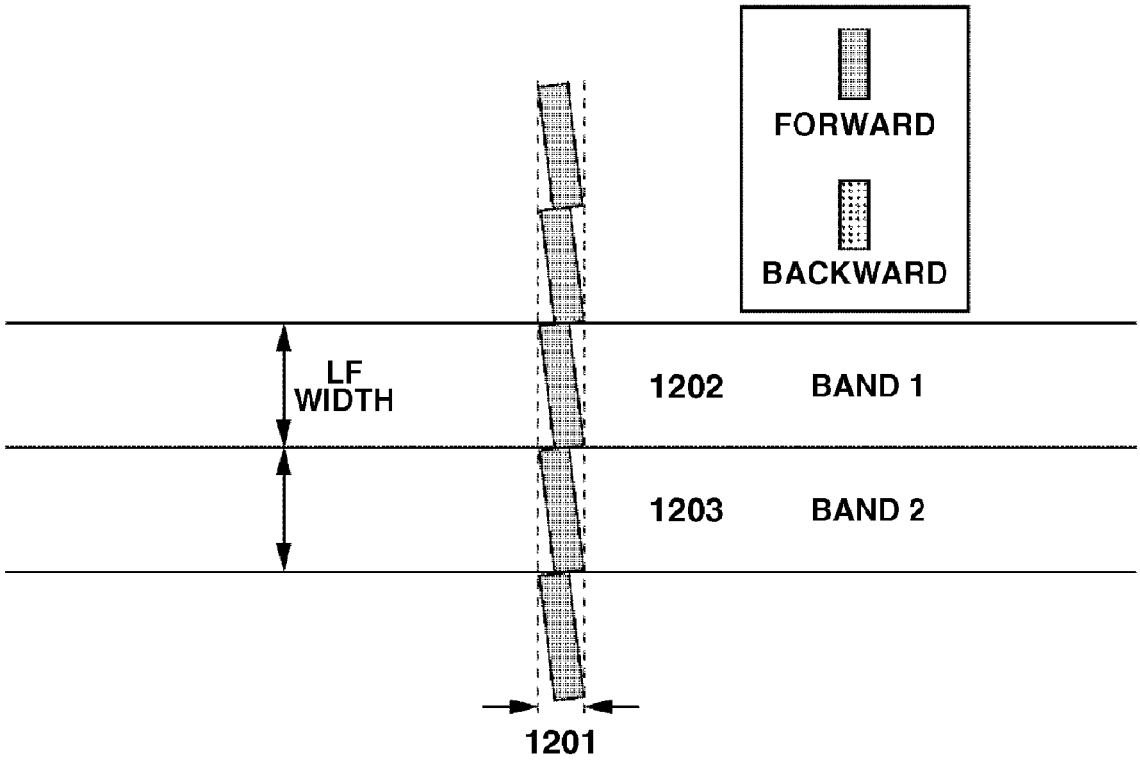
FIG. 12 illustrates an exemplary result of 2-pass printing performed by a recording head that has a nozzle array inclined relative to the LF direction and is subjected to a conventional inclination correction.

FIG. 12 illustrates an exemplary result (1202, 1203) of 2-pass printing obtained when a conventional inclination correction is applied to a deteriorated image formed according to the above-described conditions of the example 3.

Figure 13:
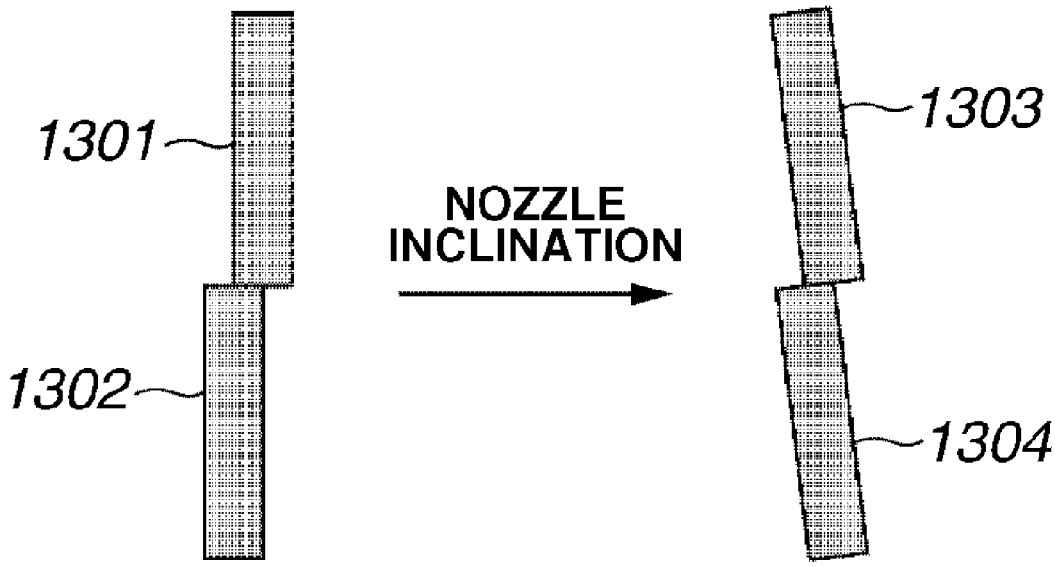
FIG. 13 illustrates an exemplary dot position shifting performed in an inclination correction.

FIG. 13 illustrates exemplary settings with respect to a recording position correction amount (dot position shifting amount) for each nozzle section according to the conventional inclination correcting method. A section number is equal to a pass number.

According to the example illustrated in FIG. 13, a nozzle array is divided into a nozzle section 1301 (upper nozzle group) and a nozzle section 1302 (lower nozzle group), as two independent objects to be driven and controlled.

A conventional inclination correction includes shifting the nozzle section 1302 in the main scanning direction by an amount equal to 1 dot/1200 dpi without changing the drive timing of the nozzle section 1301. FIG. 13 illustrates exemplary rules (printed results 1303 and 1304) subjected to the inclination correction in the printing operation.

A width 1201 illustrated in FIG. 12 which represents an impact deviation amount in the example 5 is shorter than a width 801 illustrated in FIG. 8 which represents an impact deviation amount in the example 3 (not being subjected to any inclination correction). In other words, the printing result being subjected to the inclination correction has a short impact position deviation width compared to the printing result being subjected to no inclination correction (width 1201<width 801). Thus, it is understood that the impact deviation amount in the main scanning direction can be reduced by performing the inclination correction.

Namely, the inclination correction is effective to obtain a modified rule resembling an ideal vertical rule. In other words, the inclination correction can limit deterioration in the granular quality.

EXAMPLE 6

Figure 14:
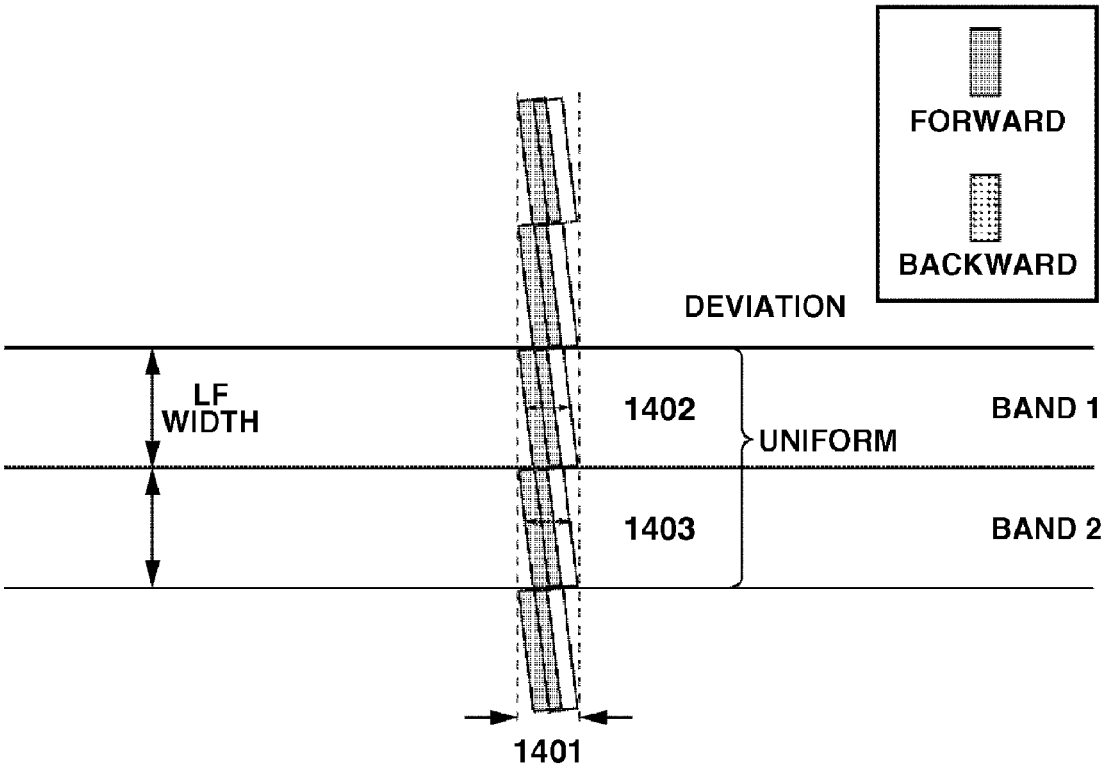
FIG. 14 illustrates an exemplary result of 2-pass printing performed by a recording head that has a nozzle array inclined relative to the LF direction, when forward/backward misregistration is generated and a conventional inclination correction is performed.

Inclination of nozzle array: inclined
Misregistration in forward/backward directions: generated
Inclination correction: conventional correction
granular quality is bad and band unevenness is not generated More specifically,
X deviation at nozzle front/rear edges in 2-pass printing: 1 dot/600 dpi
Amount of forward/backward misregistration: 1 dot/1200 dpi FIG. 14 illustrates an exemplary result (vertical rule) of a 2-pass printing obtained when the forward/backward misregistration is 1 dot/1200 dpi in addition to the above-described conditions for the example 5.

According to example 6, as understood from printed results 1402 and 1403, the impact deviation amount is the same in the band 1 and the band 2. In short, the example 6 has not generated band unevenness although the example 6 is dissatisfactory in granular quality because of the forward/backward misregistration.

From the above-described examples 5 and 6, it is understood that, if the conventional inclination correction is performed when the nozzle array is inclined, the impact position deviation width in the main scanning direction can be reduced. As a result, an output image resembling an ideal state can be obtained.

Hereinafter, based on the knowledge obtained from the above-described examples, an exemplary application of the conventional inclination correcting method to a deteriorated image is described with reference to examples 7 through 9. As described below, the conventional inclination correcting method cannot suppress generation of band unevenness when forward/backward misregistration is generated in a 4-pass multi-pass printing operation.

EXAMPLE 7

Inclination of nozzle array: inclined
Misregistration in forward/backward directions: not generated
granular quality is bad and band unevenness is not generated. More specifically,
X deviation at nozzle front/rear edges in 4-pass printing: 1 dot/300 dpi
Amount of forward/backward misregistration: 0

Figure 16:
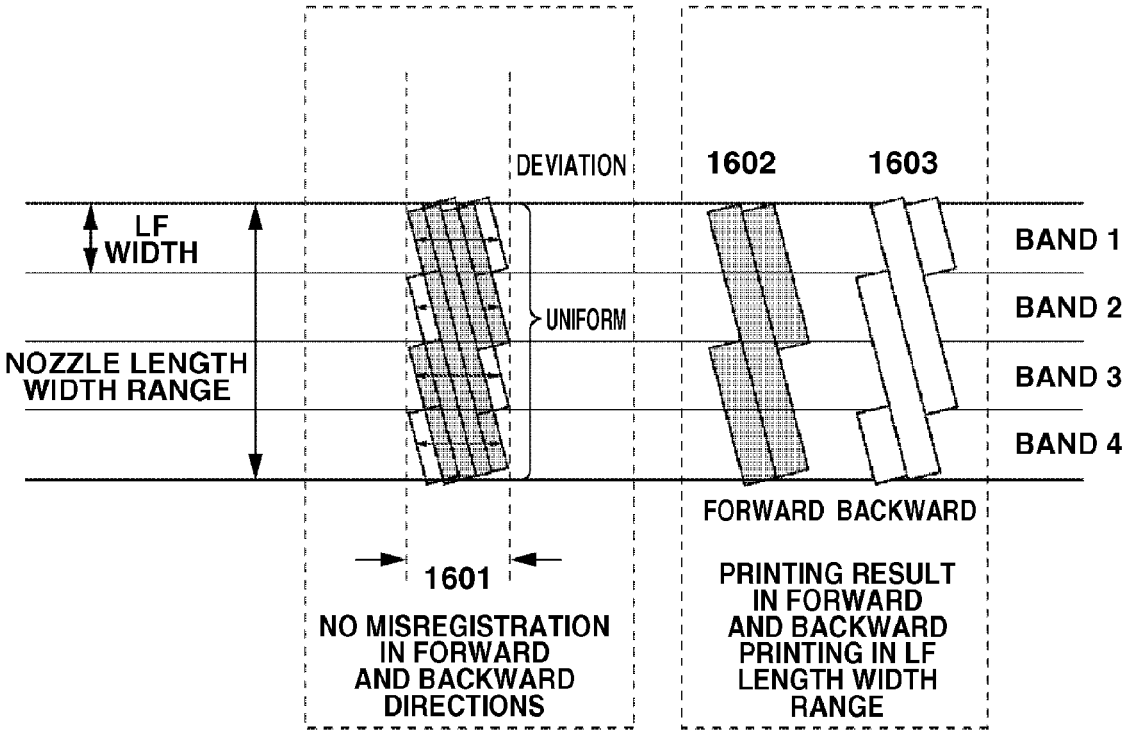
FIG. 16 illustrates an exemplary result of 4-pass printing obtained when no inclination correction is performed.

FIG. 16 illustrates an exemplary result 1601 of 4-pass printed obtained when the nozzle array is inclined and misregistration in forward/backward directions is not generated. The example 7 is not subjected to the conventional inclination correction.

According to the printed result 1601, the impact position deviation width in the main scanning direction is uniform. A printed result 1602 represents a printed result in a forward scanning operation. A printed result 1603 represents a printed result in a backward scanning operation.

According to the example illustrated in FIG. 16, the recording head performs recording of the band 1 in a backward scanning operation (refer to printed result 1603). After the LF operation is completed, the recording head performs recording of the bands 1 and 2 in a forward scanning operation (refer to printed result 1602). Then, after the LF operation is completed again, the recording head performs recording of the bands 1, 2, and 3 in a backward scanning operation. In this manner, the printer repeats the recording scanning operation and the LF operation to obtain the printed result 1601. As a result, the example 7 has not generated band unevenness although the example 7 is dissatisfactory in granular quality.

EXAMPLE 8

Inclination of nozzle array: inclined
Misregistration in forward/backward directions: not generated
Inclination correction: conventional correction
granular quality is good and no band unevenness is generated More specifically,
X deviation at nozzle front/rear edges in 4-pass printing: 1 dot/300 dpi
Amount of forward/backward misregistration: 0

Figure 15:
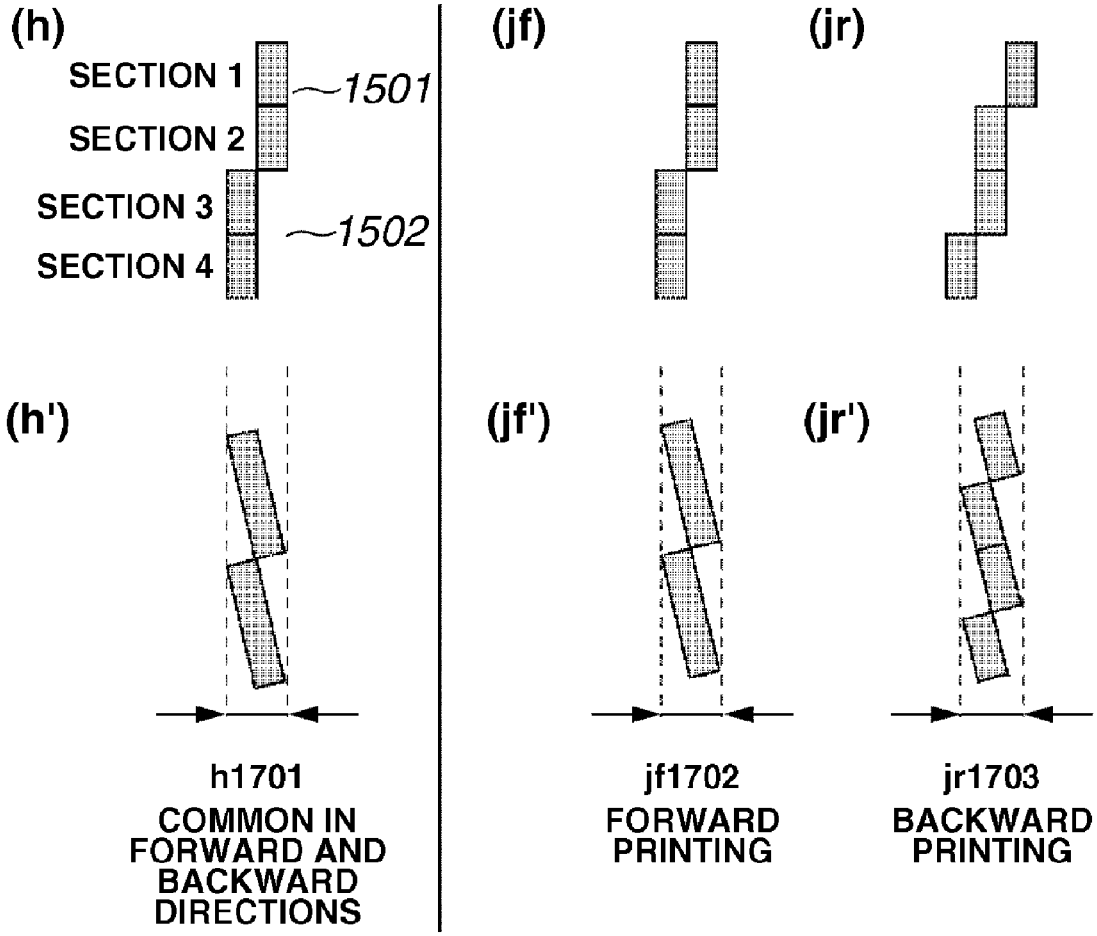
FIG. 15 illustrates an exemplary dot position shifting performed in an inclination correction.
Figure 17:
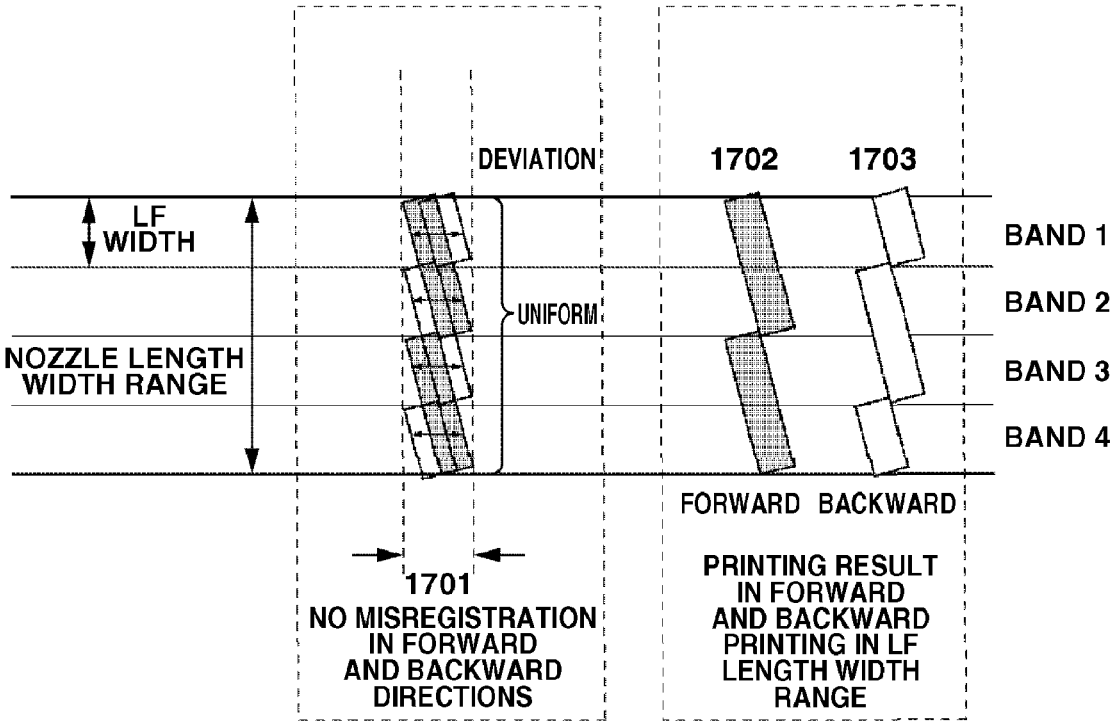
FIG. 17 illustrates an exemplary result of 4-pass printing performed by a recording head that has a nozzle array inclined relative to the LF direction, when forward/backward misregistration is not generated and a conventional inclination correction is performed.

FIG. 17 illustrates an exemplary result of 4-pass printing obtained when the conventional inclination correction is applied to a deteriorated image in the above-described conditions of nozzle inclination for the example 7. FIG. 15 illustrates exemplary printed results (h) and (h') of the example 8.

A conventional inclination correction applied to the example 8 includes shifting the drive timing for nozzle sections 3 and 4 (refer to 1502) in the main scanning direction by an amount equal to 600 dpi without changing the drive timing for nozzle sections 1 and 2 (refer to 1501).

According to the conventional inclination correction applied to the example 8, the correction amount being set for each nozzle section is the same in a forward scanning operation and a backward scanning operation.

Furthermore, similar to the example 7, the right part of FIG. 15 illustrates a printed result in a forward scanning operation and a printed result in a backward scanning operation. An impact position deviation width 1701 of a printing illustrated in FIG. 17 in the main scanning direction is shorter than an impact position deviation width 1601 of the printing result being not subjected to the inclination correction (i.e., width 1701<width 1601).

Thus, it is understood that the example 8 has generated an output image resembling an ideal state by performing the inclination correction. Furthermore, the impact deviation amount in the main scanning direction is uniform. No band unevenness has been generated.

EXAMPLE 9

Figure 18:
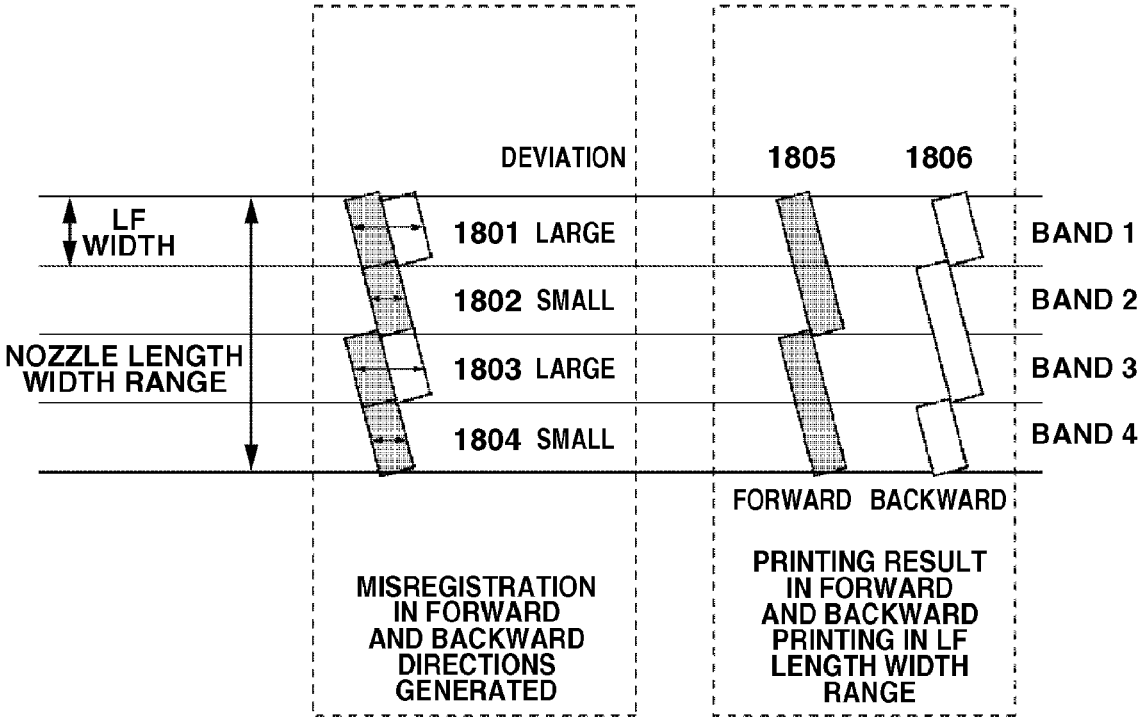
FIG. 18 illustrates an exemplary result of 4-pass printing that includes misregistration in forward/backward directions after a conventional correction (h) is performed.

Inclination of nozzle array: inclined
Misregistration in forward/backward directions: generated Inclination correction: conventional correction granular quality is good and band unevenness is generated More specifically, X deviation at nozzle front/rear edges in 4-pass printing: 1 dot/300 dpi Amount of forward/backward misregistration: 1 dot/1200 dpi FIG. 18 illustrates an exemplary result of 4-pass printing obtained when the forward/backward misregistration is 1 dot/1200 dpi in addition to the above-described conditions for the example 8.

According to the example 9, a printed result 1805 in a forward scanning operation is similar to the printed result 1702 illustrated in FIG. 17. A printed result 1806 in a backward scanning operation is similar to the printed result 1703 illustrated in FIG. 17. However, as understood from the left part of FIG. 17, an impact deviation amount in each band is different due to forward/backward misregistration. In other words, the example 9 has generated band unevenness.

From the above-described examples 7 and 8, it is understood that an output image resembling an ideal state can be formed by performing the conventional inclination correction if no deviation is generated in the forward/backward registration.

However, as described above, if any misregistration in forward/backward directions is generated, an output image includes band unevenness which cannot be removed by the conventional inclination correction.

The band unevenness can be clearly recognized even when the amount of forward/backward misregistration is 1 dot/1200 dpi or less. In general, users are sensitive to any deterioration on an image and therefore a deteriorated image tends to be recognized as having an extremely lower quality level.

First Exemplary Embodiment

Hereinafter, an exemplary embodiment of the present invention applicable to the above-described example 9 is described.

An image recording apparatus according to an embodiment has a recording head including a total of 192 nozzles. The inclination of a nozzle array is 1 dot/300 dpi. The recorded dot deviation resolution (i.e., the resolution enabling adjustment of dot position) is 1 dot/600 dpi.

Figure 30:
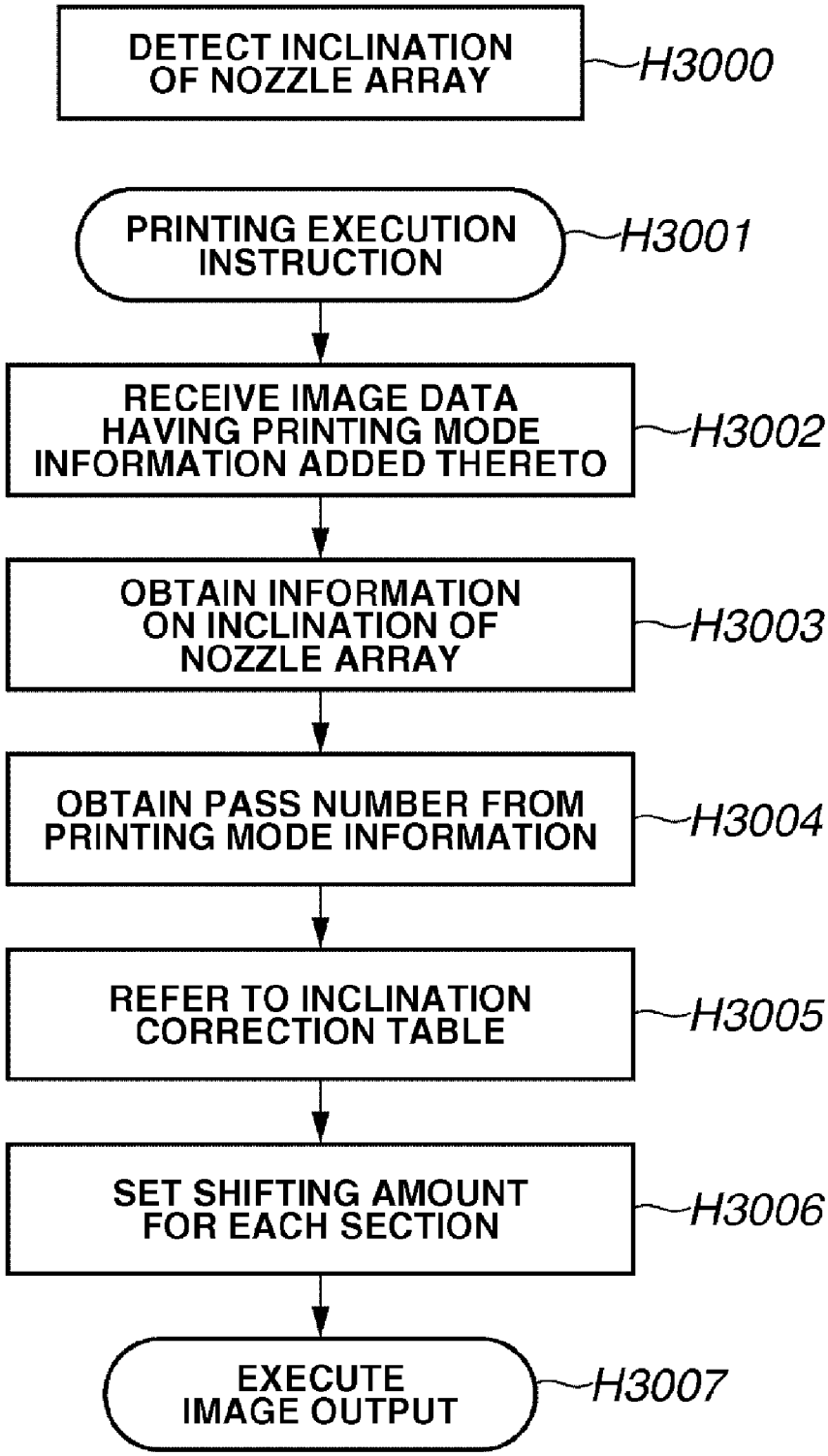
FIG. 30 is a flowchart illustrating an exemplary control sequence according to an exemplary embodiment of the present invention.
Figure 31:
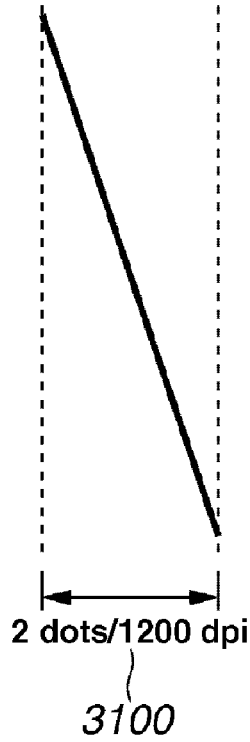
FIG. 31 illustrates an exemplary printing result formed by a nozzle array inclined by an amount equal to 2 dots/1200 dpi.
Figure 32:
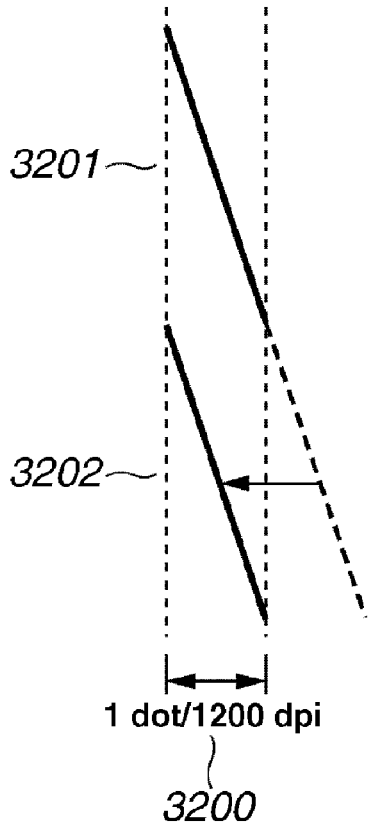
FIG. 32 illustrates an exemplary printing result subjected to a conventional inclination correction.

FIG. 30 is a flowchart illustrating an exemplary sequence performed by the image recording apparatus.

First, in step H3000, the image recording apparatus detects an inclination of nozzle array, as pre-processing for outputting an arbitrary image. More specifically, the image recording apparatus outputs a predetermined inclination pattern to detect an inclination of the nozzle. A user or a sensor reads the pattern and manually or automatically inputs the result to the image recording apparatus. The image recording apparatus detects an inclination of the nozzle array and stores the detected inclination.

Next, in step H3001, a user instructs print processing of an intended image with a printing mode. The printing mode in an embodiment includes the settings relating to pass number, data resolution, drive resolution, recorded dot deviation resolution, recording medium, and printing quality.

In step H3002, the image recording apparatus receives image data together with the above-described print mode information.

Next, in step H3003, an inclination detection unit obtains inclination information. In step H3004, a printing mode detection unit obtains a printing mode from the received image data. In an embodiment, the inclination of the nozzle array detected by the inclination detection unit is 1 dot/300 dpi. The image recording apparatus executes 4-pass forward/backward printing to form an image on a recording medium, such as a photo image paper.

Next, in step H3005, the image recording apparatus refers to an inclination correction table 1 that stores a recording position correction amount (i.e., dot position shifting amount) for each section of the nozzle array relative to the nozzle inclination. The number of nozzle sections is equal to a pass number. Each nozzle section may be referred to as "group" in the following description.

Then, in step H3006, the image recording apparatus sets a recording position correction amount (i.e., dot position shifting amount) for each section.

As indicated by (jf) and (jr) in FIG. 15, the inclination correction according to an embodiment includes shifting the sections 3 and 4 by an amount equal to 1 dot/600 dpi in the main scanning direction, without shifting the sections 1 and 2, in a forward scanning operation.

Furthermore, the inclination correction according to an embodiment includes shifting the sections 2 and 3 by an amount equal to 1 dot/600 dpi and shifting the section 4 by an amount equal to 1 dot/300 dpi(=1 dot/600 dpi×2) in the main scanning direction, without shifting the section 1, in a backward scanning operation.

Namely, in an embodiment, a shift amount being set for each section in a forward scanning operation is different from a shift amount being set for each section in a backward scanning operation. In FIG. 15, (jf') and (jr') represent recorded images resulting from the above-described inclination correction.

Figure 19:
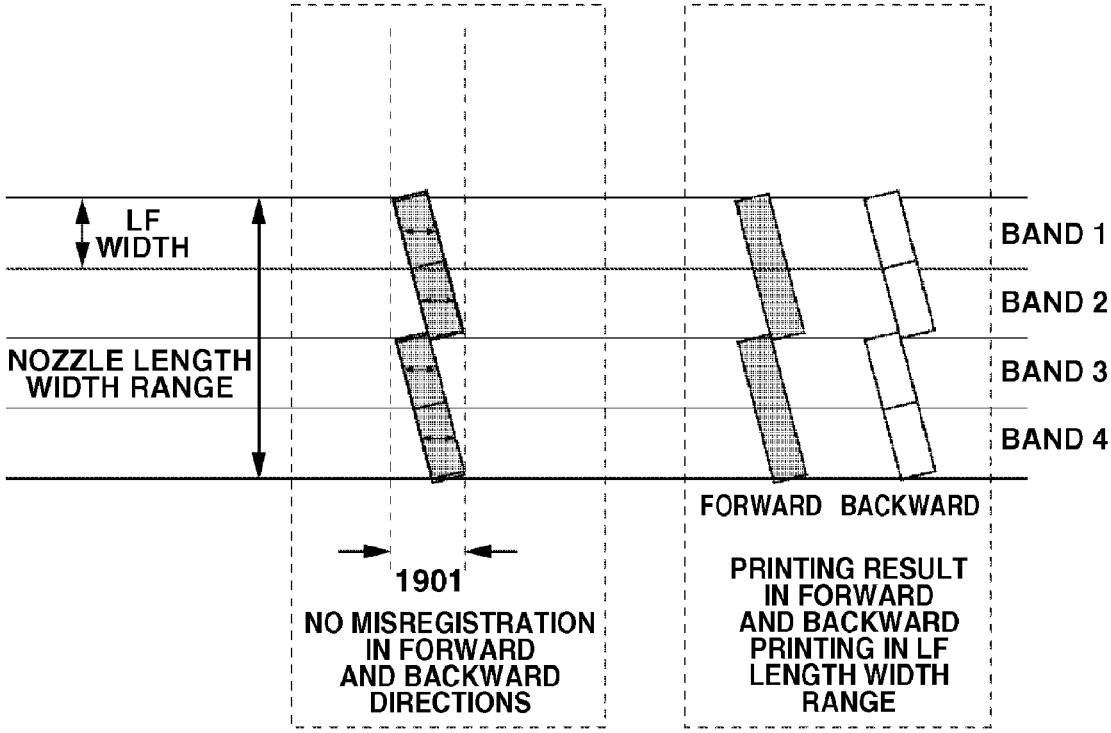
FIG. 19 illustrates an exemplary result of 4-pass printing being subjected to a correction (jr)+(jf) according to an exemplary embodiment.

FIG. 19 illustrates an exemplary output of a vertical rule being subjected to the inclination correction indicated by (jf)+(jr). The vertical rule illustrated in FIG. 19 has an impact position deviation width 1901 in the main scanning direction. The impact position deviation width 1901 is shorter than the impact position deviation width 1601 of the printing result being not subjected to the inclination correction (refer to FIG. 16). Thus, it is understood that the inclination correction according to an embodiment can suppress deterioration in the granular quality when the image recording apparatus performs a multi-pass printing operation.

Figure 20:
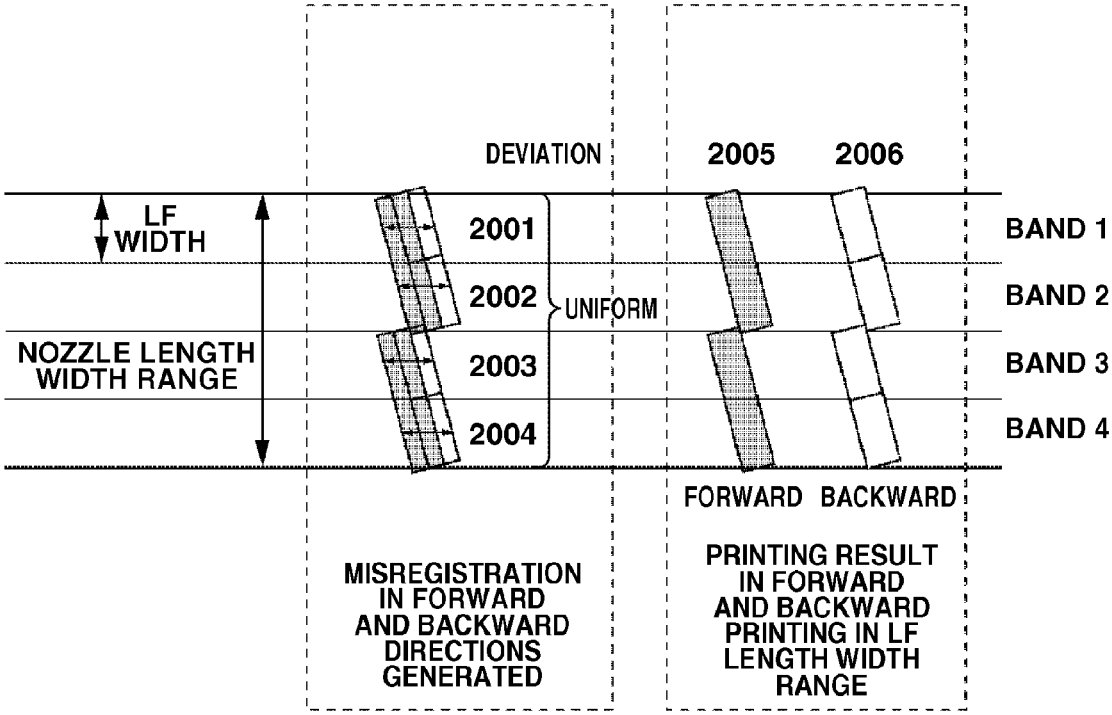
FIG. 20 illustrates an exemplary result of 4-pass printing being subjected to a correction (jr)+(jf) according to an exemplary embodiment when misregistration is generated in forward/backward directions.

An embodiment can suppress band unevenness when misregistration is generated in forward/backward directions. In an embodiment, the forward/backward misregistration is 1 dot/1200 dpi. FIG. 20 illustrates an exemplary printed result, according to which the impact deviation amount in each band is uniform as indicated by 2001 through 2004. In other words, the present embodiment has generated no band unevenness.

Namely, as illustrated in FIG. 15, the present embodiment differentiates a recording position correction amount (i.e., dot position shifting amount) in a forward scanning operation (also referred to herein as "forward scanning recording position correction amount"), from a recording position correction amount in a backward scanning operation (also referred to herein as "backward scanning recording position correction amount"). Thus, the present embodiment can form a forward printing output 2005 and a backward printing output 2006 which have the same shape and are overlapped as an output result.

A comparative example is described below. The comparative example is similar to the present embodiment in the inclination of a nozzle array, the amount of forward/backward misregistration, and the dot position shifting resolution (=600 dpi).

The comparative example has been subjected to the conventional correction indicated by (h)(=(jf)) in FIG. 15, according to which the recording position correction amount (i.e., dot position shifting amount) in a forward scanning operation is similar to the recording position correction amount in a backward scanning operation.

As apparent from printed results 1801 through 1804 in FIG. 18, the impact deviation amount in each band is not uniform due to forward/backward misregistration. Thus, the conventional correcting method cannot suppress generation of band unevenness.

Second Exemplary Embodiment

Next, a second exemplary embodiment according to the present invention is described. An image recording apparatus according to the second exemplary embodiment has a recording head including a total of 192 nozzles. The inclination of a nozzle array is 1 dot/300 dpi. The recorded dot deviation resolution is 900 dpi.

The image recording apparatus of the present embodiment performs correction processing according to the flowchart illustrated in FIG. 30 (i.e., a sequence for executing the control of the present embodiment). In the present embodiment, the inclination of the nozzle array detected by the inclination detection unit is 1 dot/300 dpi. The image recording apparatus executes 6-pass forward/backward printing to form an image on a recording medium, such as a photo image paper.

Next, in step H3005, the image recording apparatus refers to an inclination correction table 2 that stores a dot position shifting amount for each section of the nozzle array relative to the nozzle inclination. Then, in step H3006, the image recording apparatus sets a dot position shifting amount for each section. The number of nozzle sections is equal to a pass number.

Figure 21:
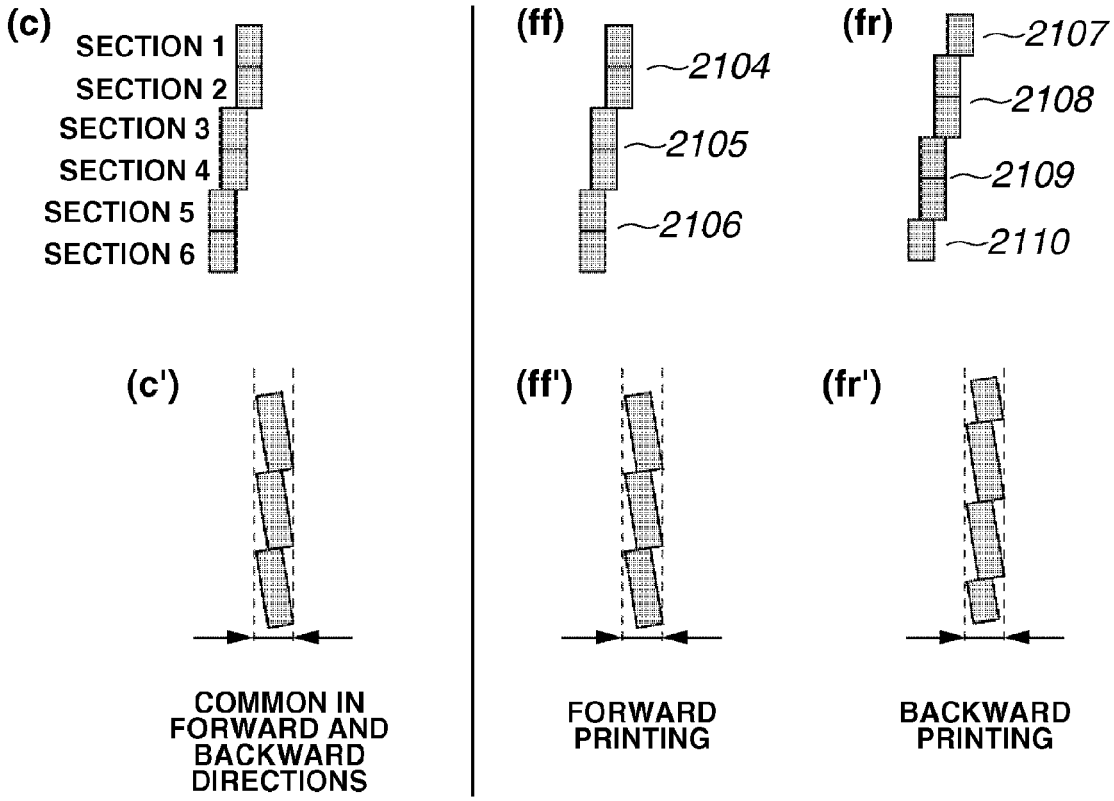
FIG. 21 illustrates an exemplary dot position shifting performed in an inclination correction.

As indicated by (ff) and (fr) in FIG. 21, the inclination correction according to the present embodiment includes shifting the sections 3 and 4 (refer to 2105) by an amount equal to 1 dot/900 dpi and shifting the sections 5 and 6 (refer to 2106) by an amount equal to 1 dot/450 dpi (900 dpi×2) in the main scanning direction, without shifting the sections 1 and 2 (refer to 2104), in a forward scanning operation.

Furthermore, the inclination correction according to the present embodiment includes shifting the sections 2 and 3 (refer to 2108) by an amount equal to 1 dot/900 dpi, shifting the sections 4 and 5 (refer to 2109) by an amount equal to 1 dot/450 dpi (1 dot/900 dpi×2), and shifting the section 6 (refer to 2110) by an amount equal to 1 dot/300 dpi(1 dot/900 dpi×3) in the main scanning direction, without shifting the section 1 (refer to 2107), in a backward scanning operation.

Figure 22:
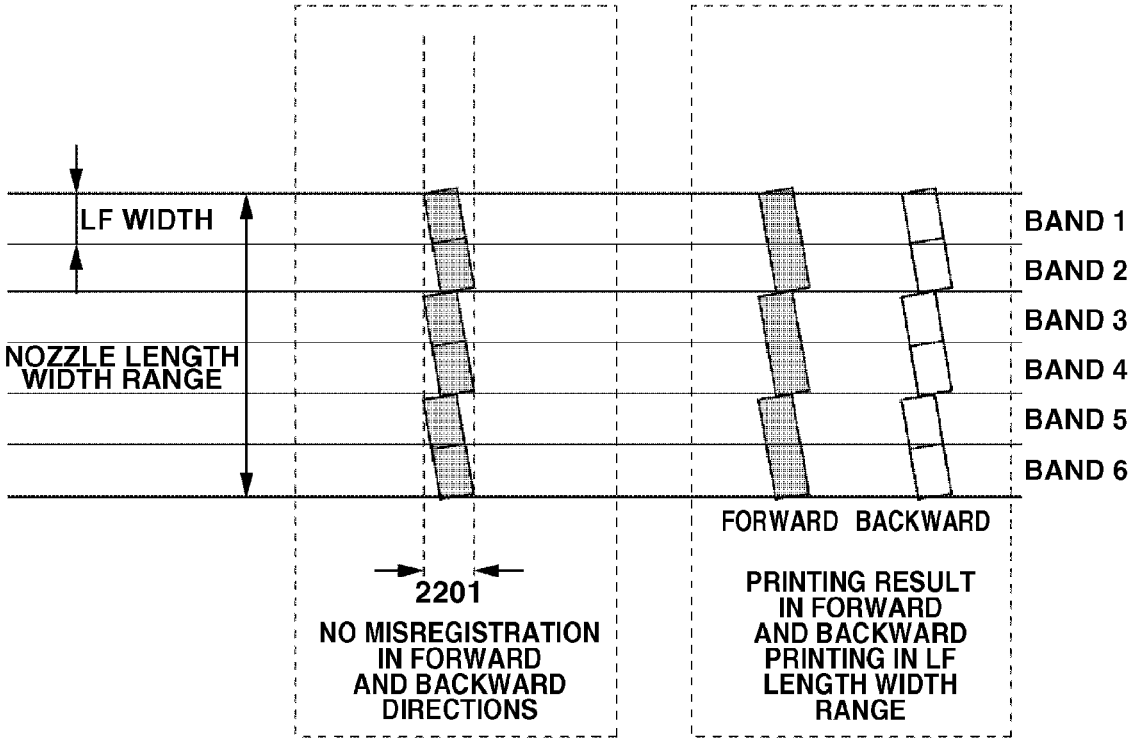
FIG. 22 illustrates an exemplary result of 6-pass printing being subjected to a correction (ff)+(fr) according to an exemplary embodiment.
Figure 23:
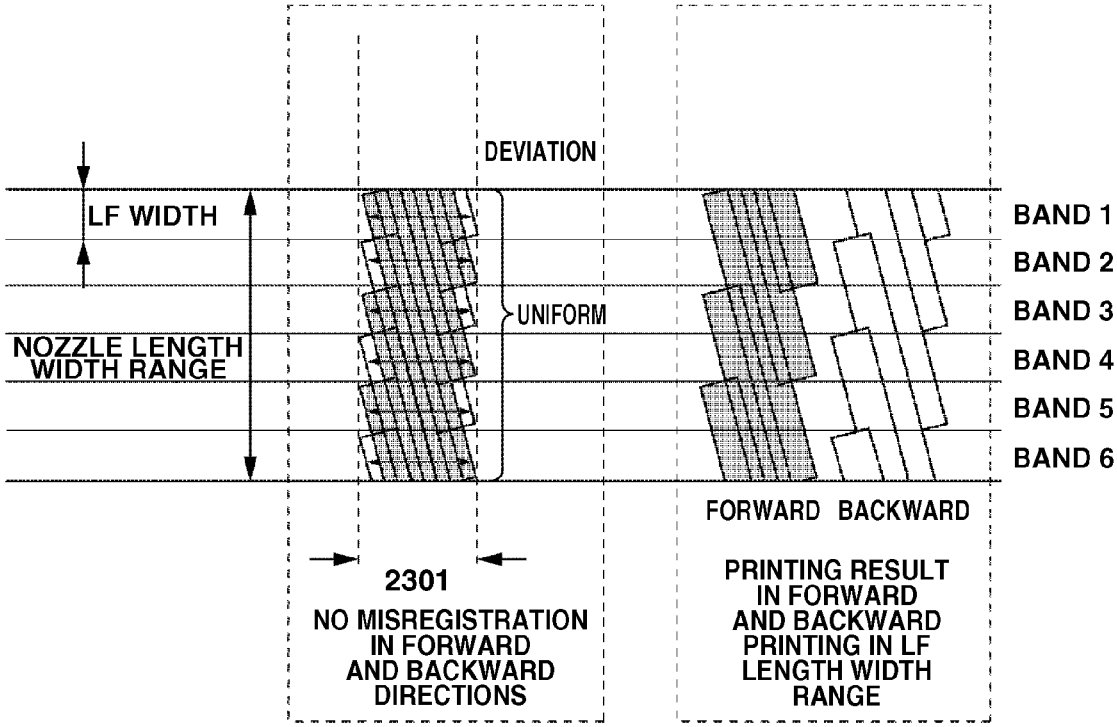
FIG. 23 illustrates an exemplary result of 6-pass printing being not subjected to inclination correction.

FIG. 22 illustrates an exemplary output of a vertical rule being subjected to the inclination correction indicated by (ff)+(fr). The vertical rule illustrated in FIG. 22 has an image width 2201. The image width 2201 is shorter than an impact position deviation width 2301 (FIG. 23) of a printing result being not subjected to the inclination correction. Thus, it is understood that the inclination correction according to the present embodiment can suppress deterioration in the granular quality when the image recording apparatus performs a multi-pass printing operation.

Figure 24:
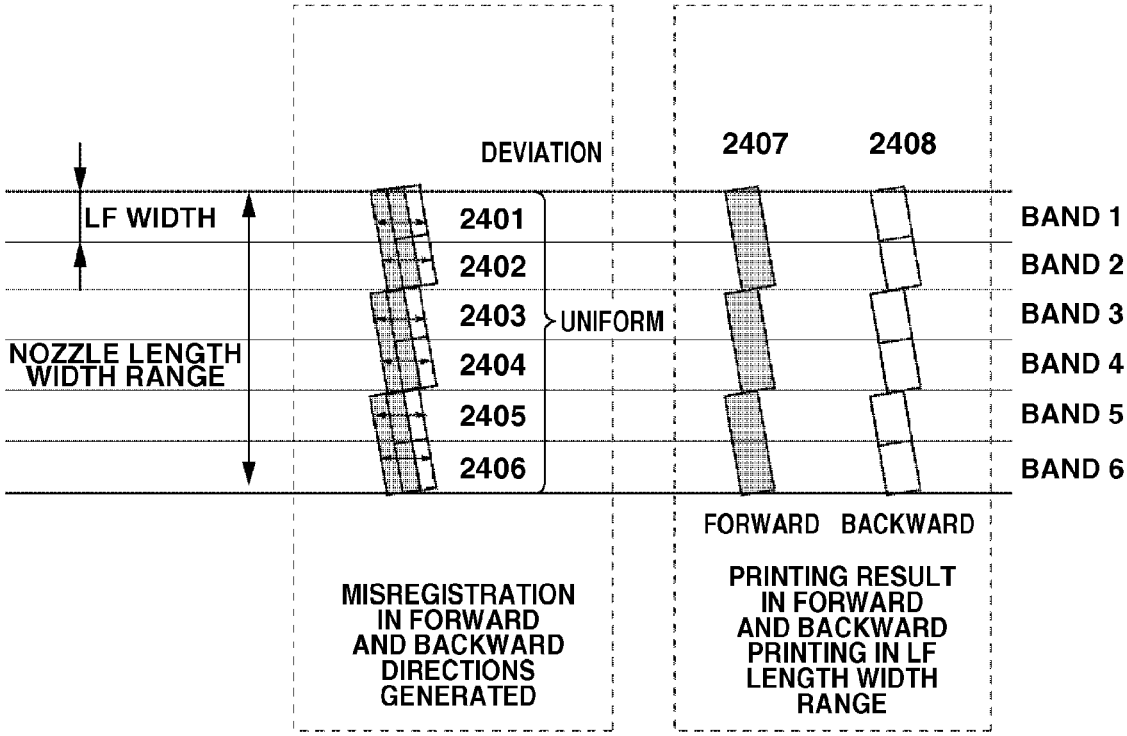
FIG. 24 illustrates an exemplary result of 6-pass printing being subjected to a correction (ff)+(fr) according to an exemplary embodiment when misregistration is generated in forward/backward directions.

The present embodiment can suppress band unevenness when misregistration is generated in forward/backward directions. In the present embodiment, the forward/backward misregistration is 1 dot/1200 dpi. FIG. 24 illustrates an exemplary printed result, according to which the impact deviation amount in each band is uniform as indicated by 2401 through 2406. In other words, the present embodiment has generated no band unevenness.

Namely, the present embodiment differentiates a dot position shifting amount in a forward scanning operation (also referred to herein as "forward scanning recording position correction amount") from a dot position shifting amount in a backward scanning operation (also referred to herein as "backward scanning recording position correction amount"). Thus, the present embodiment can form a forward printing output 2407 and a backward printing output 2408 which have the same shape and are overlapped as an output result.

A comparative example is described below. The comparative example is similar to the present embodiment in the inclination of a nozzle array, the amount of forward/backward misregistration, and the dot position shifting resolution (=900 dpi).

The comparative example has been subjected to the conventional correction indicated by (c)(=(ff)) in FIG. 21, according to which the dot position shifting amount in a forward scanning operation is similar to the dot position shifting amount in a backward scanning operation.

Figure 25:
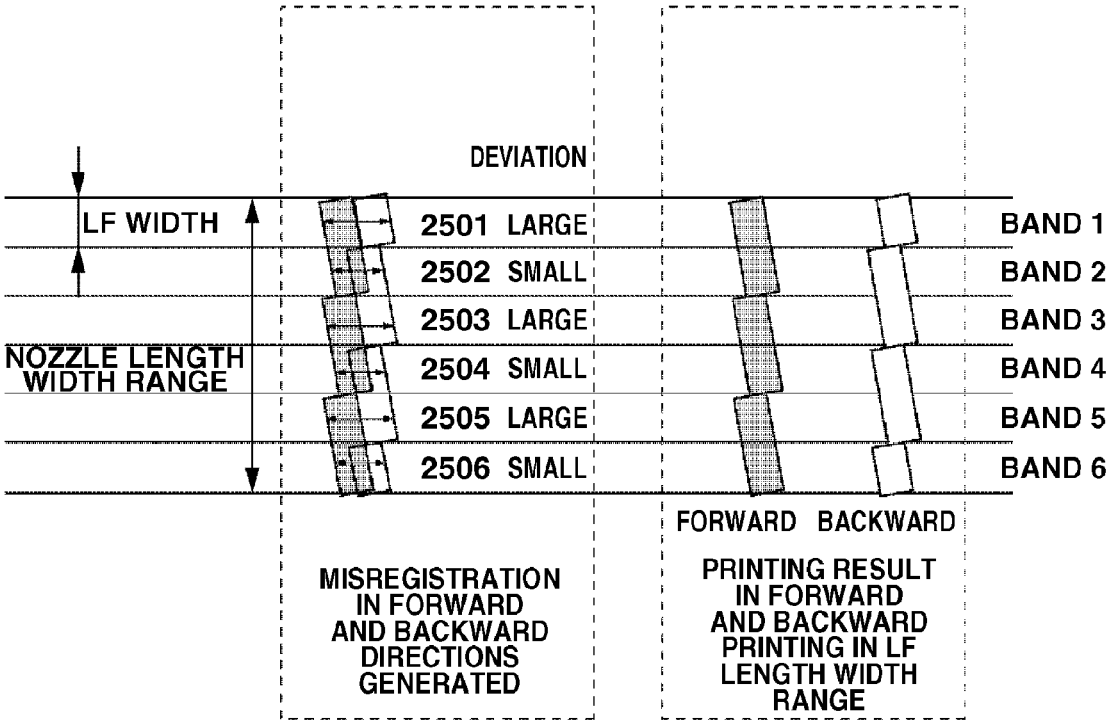
FIG. 25 illustrates an exemplary result of 6-pass printing being subjected to a conventional correction (c).

As apparent from printed results 2501 through 2506 in FIG. 25, the impact deviation amount in each band is not uniform due to forward/backward misregistration. Thus, the conventional correcting method cannot suppress generation of band unevenness.

Third Exemplary Embodiment

Next, a third exemplary embodiment according to the present invention is described. An image recording apparatus according to the third exemplary embodiment has a recording head including a total of 192 nozzles. The inclination of a nozzle array is 1 dot/300 dpi. The recorded dot deviation resolution is 300 dpi.

The image recording apparatus of the present embodiment performs correction processing according to the flowchart illustrated in FIG. 30 (i.e., a sequence for executing the control of the present embodiment). In the present embodiment, the inclination of the nozzle array detected by the inclination detection unit is 1 dot/300 dpi. The image recording apparatus executes 6-pass forward/backward printing to form an image on a recording medium, such as a photo image paper.

Next, in step H3005, the image recording apparatus refers to an inclination correction table 3 that stores a dot position shifting amount for each section of the nozzle array relative to the nozzle inclination. Then, in step H3006, the image recording apparatus sets a dot position shifting amount for each section. The number of nozzle sections is equal to a pass number.

Figure 26:
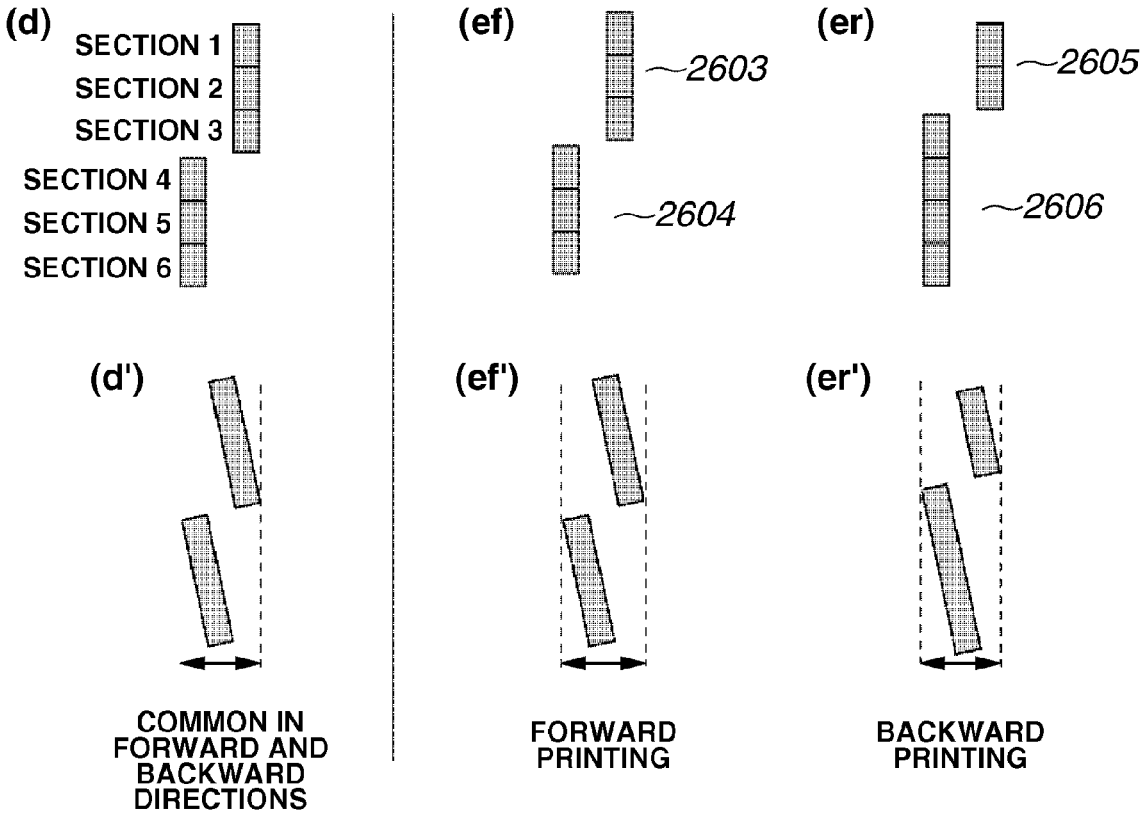
FIG. 26 illustrates an exemplary dot position shifting performed in an inclination correction.

As indicated by (ef) and (er) in FIG. 26, the inclination correction according to the present embodiment includes shifting the sections 4 through 6 (refer to 2604) by an amount equal to 1 dot/300 dpi in the main scanning direction, without shifting the sections 1 through 3 (refer to 2603), in a forward scanning operation.

Furthermore, the inclination correction according to the present embodiment includes shifting the sections 3 through 6 (refer to 2606) by an amount equal to 1 dot/300 dpi in the main scanning direction, without shifting the sections 1 and 2 (refer to 2605), in a backward scanning operation.

Figure 27:
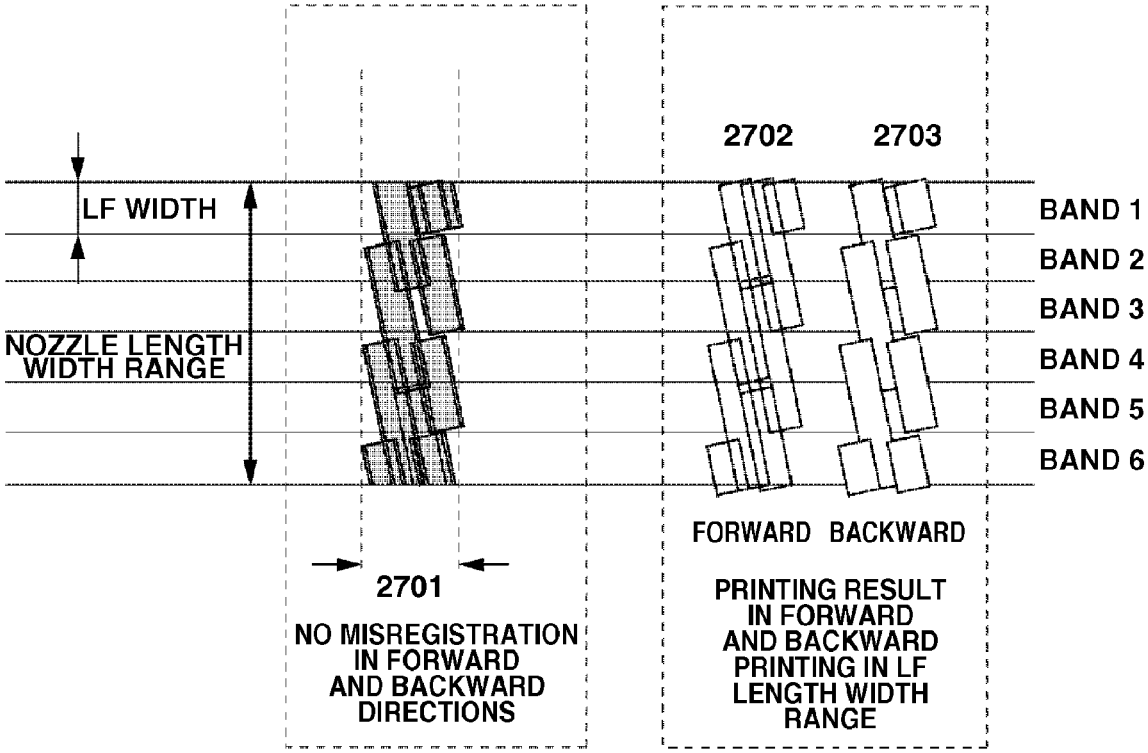
FIG. 27 illustrates an exemplary result of 6-pass printing being subjected to a correction (ef)+(er) according to an exemplary embodiment.

FIG. 27 illustrates an exemplary output of a vertical rule being subjected to the inclination correction indicated by (ef)+(er). The vertical rule illustrated in FIG. 27 has an image width 2701. The image width 2701 is equal to the impact position deviation width 2301 (FIG. 23) of a printing result being not subjected to the inclination correction. Thus, it is understood that the inclination correction does not contribute to suppressing deterioration in the granular quality when the image recording apparatus performs a multi-pass printing operation.

Figure 28:
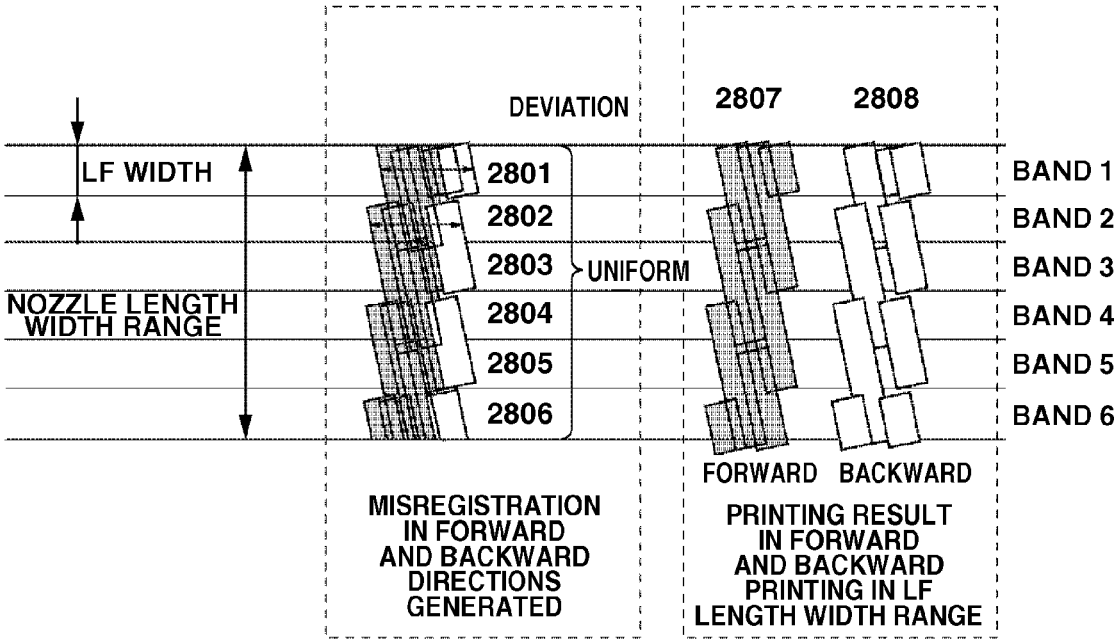
FIG. 28 illustrates an exemplary result of 6-pass printing being subjected to a correction (ef)+(er) according to an exemplary embodiment, when misregistration is generated in forward/backward directions.

However, the present embodiment can suppress band unevenness generated by a misregistration in forward/backward directions. In the present embodiment, the forward/backward misregistration is 1 dot/1200 dpi. FIG. 28 illustrates an exemplary printed result according to which the impact deviation amount in each band is uniform as indicated by 2801 through 2806. In other words, the present embodiment has generated no band unevenness.

Namely, the present embodiment differentiates a dot position shifting amount in a forward scanning operation (also referred to herein as "forward scanning recording position correction amount") from a dot position shifting amount in a backward scanning operation (also referred to herein as "backward scanning recording position correction amount"). Thus, the present embodiment can form a forward printing output 2807 and a backward printing output 2808 which have the same shape and are overlapped as an output result.

A comparative example is described below. The comparative example is similar to the present embodiment in the inclination of a nozzle array, the amount of forward/backward misregistration, and the dot position shifting resolution (=300 dpi).

The comparative example has been subjected to the conventional correction indicated by (d)(=(ef)) in FIG. 26, according to which the dot position shifting amount in a forward scanning operation is similar to the dot position shifting amount in a backward scanning operation.

Figure 29:
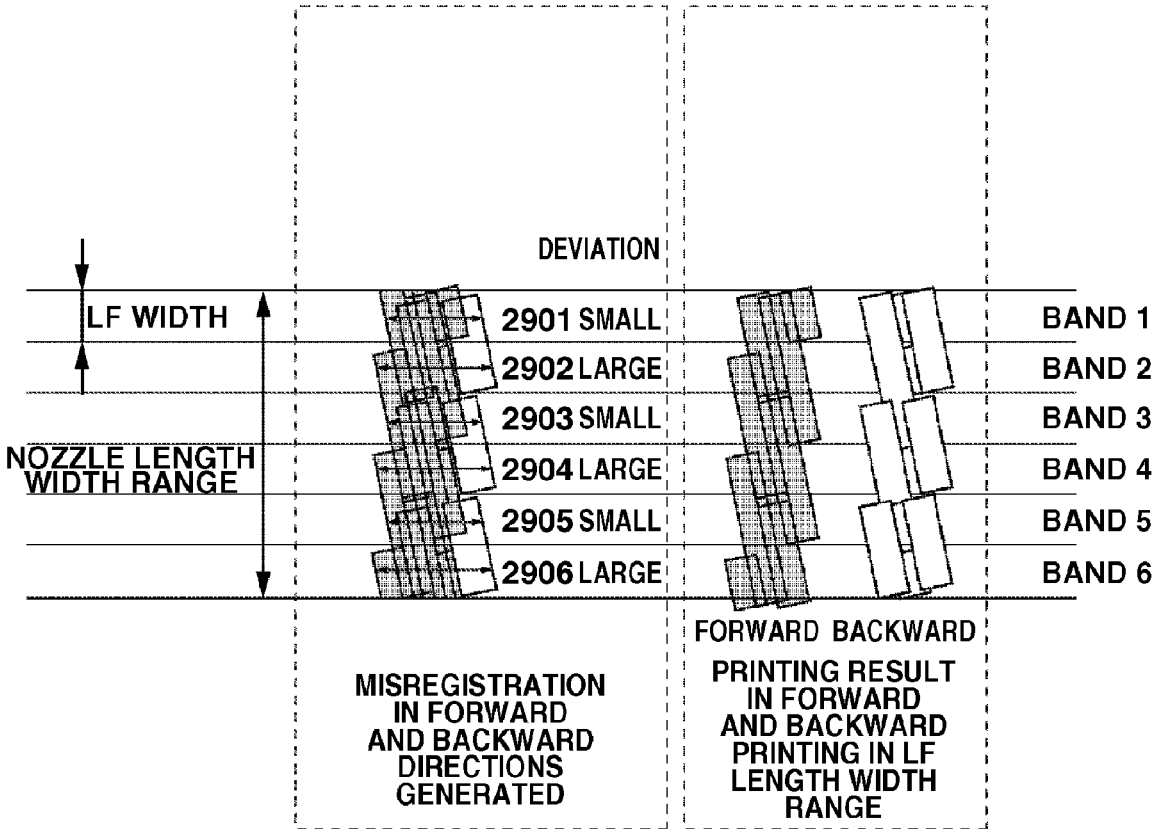
FIG. 29 illustrates an exemplary result of 6-pass printing being subjected to a conventional correction (d) that has generated misregistration in forward/backward directions.

As apparent from printed results 2901 through 2906 in FIG. 29, the impact deviation amount in each band is not uniform due to forward/backward misregistration. Thus, the conventional correcting method cannot suppress generation of band unevenness.

Table 4 describes a comparison of effects between the inclination correction according to the present embodiments and the conventional inclination correction.

Table 4 illustrates inclination correction results at two dot position shifting resolutions, i.e., at 300 dpi (exemplary embodiment 2) and 900 dpi (exemplary embodiment 3), when the inclination of a nozzle array is 1 dot/300 dpi. As apparent from the comparison, the inclination correcting method according to the present embodiments can suppress band unevenness generation and granular quality deterioration in each dot position shifting resolution.

As described above, if an image recording apparatus has an inclined recording head, the present invention differentiates a dot position shifting amount in a forward scanning operation from a dot position shifting amount in a backward scanning operation. Thus, the present invention can suppress deterioration in granular quality and reduction in image quality due to band unevenness in an output of an image.

TABLE 1

| | Nozzle inclination (/600 dpi) | | |
|---|---|---|---|
| | −2 | 0 | 2 |
| Forward scanning setting | | | |
| Section 1 (0-47 nozzles) | 0 | 0 | 0 |
| Section 2 (48-95 nozzles) | 0 | 0 | 0 |
| Section 3 (96-143 nozzles) | 1 | 0 | −1 |

TABLE 1-continued

| | Nozzle inclination (/600 dpi) | | |
|---|---|---|---|
| | −2 | 0 | 2 |
| Section 4 (144-191 nozzles) | 1 | 0 | −1 |
| | | | (/600 dpi) |
| Backward scanning setting | | | |
| Section 1 (0-47 nozzles) | 0 | 0 | 0 |
| Section 2 (48-95 nozzles) | 1 | 0 | −1 |
| Section 3 (96-143 nozzles) | 1 | 0 | −1 |
| Section 4 (144-191 nozzles) | 2 | 0 | −2 |
| | | | (/600 dpi) |

TABLE 2

| | Nozzle inclination (/600 dpi) | | |
|---|---|---|---|
| | −2 | 0 | 2 |
| Forward scanning setting | | | |
| Section 1 (0-31 nozzles) | 0 | 0 | 0 |
| Section 2 (32-63 nozzles) | 0 | 0 | 0 |
| Section 3 (64-95 nozzles) | 1 | 0 | −1 |
| Section 4 (96-127 nozzles) | 1 | 0 | −1 |
| Section 5 (128-159 nozzles) | 2 | 0 | −2 |
| Section 6 (160-191 nozzles) | 2 | 0 | −2 |
| | | | (/900 dpi) |
| Backward scanning setting | | | |
| Section 1 (0-31 nozzles) | 0 | 0 | 0 |
| Section 2 (32-63 nozzles) | 1 | 0 | −1 |
| Section 3 (64-95 nozzles) | 1 | 0 | −1 |
| Section 4 (96-127 nozzles) | 2 | 0 | −2 |
| Section 5 (128-159 nozzles) | 2 | 0 | −2 |
| Section 6 (160-191 nozzles) | 3 | 0 | −3 |
| | | | (/900 dpi) |

TABLE 3

| | Nozzle inclination (/600 dpi) | | |
|---|---|---|---|
| | −2 | 0 | 2 |
| Forward scanning setting | | | |
| Section 1 (0–31 nozzles) | 0 | 0 | 0 |
| Section 2 (32–63 nozzles) | 0 | 0 | 0 |
| Section 3 (64–95 nozzles) | 0 | 0 | 0 |
| Section 4 (96–127 nozzles) | 2 | 0 | −2 |
| Section 5 (128–159 nozzles) | 2 | 0 | −2 |
| Section 6 (160–191 nozzles) | 2 | 0 | −2 |
| | | | (/600 dpi) |
| Backward scanning setting | | | |
| Section 1 (0–31 nozzles) | 0 | 0 | 0 |
| Section 2 (32–63 nozzles) | 0 | 0 | 0 |
| Section 3 (64–95 nozzles) | 2 | 0 | −2 |
| Section 4 (96–127 nozzles) | 2 | 0 | −2 |
| Section 5 (128–159 nozzles) | 2 | 0 | −2 |
| Section 6 (160–191 nozzles) | 2 | 0 | −2 |
| | | | (/600 dpi) |

TABLE 4

| | Correction method (6PASS) | | | |
|---|---|---|---|---|
| | (ef + er) | (d) | (ff + fr) | (c) |
| Dot position shifting resolution | 300 dpi | 300 dpi | 900 dpi | 900 dpi |
| Granular quality deterioration suppressing effect | — | — | good | good |
| Band unevenness suppressing effect | good | bad | good | bad |

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-170250 filed Jun. 20, 2006, which is hereby incorporated by reference herein in its entirety.

What is claimed is:

1. An inkjet recording apparatus that includes a recording head having a nozzle array of plural nozzles capable of discharging ink, wherein the inkjet recording apparatus shifts the recording head in forward and backward directions along a main scanning direction to perform scanning and recording operations for discharging the ink from the nozzles onto a recording medium to form an image, and the inkjet recording apparatus conveys the recording medium in a sub scanning direction intersectional to the main scanning direction, the inkjet recording apparatus comprising:

an acquiring unit configured to obtain information relating to an inclination of the nozzle array of the recording head relative to the sub scanning direction;

a dividing unit configured to divide the nozzle array into a plurality of sections; and a recording position correction unit configured to correct, in the main scanning direction, the position of dots recorded by a nozzle group of each section, wherein the recording position correction unit sets a recording position correction amount for each section based on the information relating to the inclination, so that a recording position correction amount in a forward scanning operation is different from a recording position correction amount in a backward scanning operation.

2. The inkjet recording apparatus according to claim 1, further comprising a printing mode detection unit configured to detect a printing mode being set, wherein a number of sections divided by the dividing unit is determined based on a detection result obtained by the printing mode detection unit.

3. The inkjet recording apparatus according to claim 1, wherein the recording position correction unit sets a recording position correction amount for each section so that a printed result of a vertical rule formed by a nozzle array subjected to a recording position correction becomes shorter, in a width projected along the main scanning direction, than a printed result formed by a nozzle array not subjected to the recording position correction.

4. An inkjet recording apparatus according to claim 1, wherein the recording position correction unit sets a recording position correction amount for each section so that an impact position in a forward scanning operation overlaps with an impact position in a backward scanning operation, when the recording head performs a multi-pass printing to form a printed image of a vertical rule.

5. An inkjet recording apparatus according to claim 1, further comprising a table that stores a recording position correction amount relative to an inclination of the nozzle array.

6. An inkjet recording apparatus according to claim 1, wherein the recording position correction unit changes a storage memory address of image data for each section.

7. An inkjet recording apparatus according to claim 1, wherein the recording position correction unit changes drive timing for each section.

8. An inkjet recording apparatus according to claim 1, further comprising a sensor configured to read a printing pattern recorded by the recording head to obtain the information relating to the inclination.

9. An inkjet recording apparatus according to claim 1, wherein a user selects and designates a printing pattern recorded by the recording head to obtain the information relating to the inclination.

10. An inkjet recording apparatus according to claim 2, wherein the printing mode includes a pass number, data resolution, and drive resolution as information relating to print settings.

11. A method for an inkjet recording apparatus that includes a recording head having a nozzle array of plural nozzles capable of discharging ink, wherein the inkjet recording apparatus shifts the recording head in forward and backward directions along a main scanning direction to perform scanning and recording operations for discharging the ink from the nozzles onto a recording medium to form an image, and the inkjet recording apparatus conveys the recording medium in a sub scanning direction intersectional to the main scanning direction, the method comprising:

obtaining information relating to an inclination of the nozzle array of the recording head relative to the sub scanning direction;

determining a forward scanning recording position correction amount to be applied to each of nozzle sections of the nozzle array during a forward scanning operation based on the information relating to the inclination of the nozzle array of the recording head; and determining a backward scanning recording position correction amount to be applied to each of the nozzle sections of the nozzle array during a backward scanning operation based on the information relating to the inclination of the nozzle array of the recording head.

12. The method according to claim 11, wherein, with respect to at least one of the nozzle sections, a forward scanning recording position correction amount is different from a backward scanning recording position correction amount.

13. The method according to claim 11, further comprising:

dividing the nozzle arrays into a plurality of sections based on a selected printing mode.

14. The method according to claim 11, further comprising:

adjusting, in the main scanning direction, position of dots recorded by a nozzle section based on a respective recording position correct amount.

15. An inkjet recording apparatus comprising:

a recording head having a nozzle array capable of discharging ink, the nozzle array including a plurality of nozzle sections, each of the nozzle sections including a plurality of nozzles, wherein the recording head is capable of being moved in forward and backward directions along a main scanning direction to perform scanning and recording operations for discharging the ink from the nozzles onto a recording medium to form an image; and a recording position correction unit configured to determine a forward scanning recording position correction amount to be applied to each of the nozzle sections during a forward scanning operation based on information associated with an inclination of the nozzle array of the recording head, wherein the recording position correction unit is further configured to determine a backward scanning recording position correction amount to be applied to each of the nozzle sections during a backward scanning operation based on the information associated with the inclination of the nozzle array of the recording head.

16. The inkjet recording apparatus according to claim 15, wherein, with respect to at least one of the nozzle sections, a forward scanning recording position correction amount is different from a backward scanning recording position correction amount.

17. The inkjet recording apparatus according to claim 15, further comprising:

a dividing unit configured to divide the nozzle array into a plurality of nozzle sections based on a selected printing mode.

18. The inkjet recording apparatus according to claim 15, wherein a recording position correct amount is used to adjust, in the main scanning direction, position of dots recorded by a respective nozzle section.

19. The inkjet recording apparatus according to claim 15, further comprising:

a recording medium conveying unit configured to convey the recording medium in a sub-scanning direction perpendicular to the main scanning direction.

* * * * *